US011410602B2

(12) United States Patent
Kim et al.

(10) Patent No.: US 11,410,602 B2
(45) Date of Patent: Aug. 9, 2022

(54) DISPLAY DEVICE AND METHOD OF DRIVING THE SAME

(71) Applicant: Samsung Display Co., LTD., Yongin-si (KR)

(72) Inventors: Keun Woo Kim, Yongin-si (KR); Hye Na Kwak, Yongin-si (KR); Doo Na Kim, Yongin-si (KR); Han Bit Kim, Yongin-si (KR); Yong Su Lee, Yongin-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 17/092,832

(22) Filed: Nov. 9, 2020

(65) Prior Publication Data

US 2021/0210014 A1 Jul. 8, 2021

(30) Foreign Application Priority Data

Jan. 2, 2020 (KR) ..... 10-2020-0000508

(51) Int. Cl.
*G09G 3/3233* (2016.01)
*G09G 3/20* (2006.01)
(Continued)

(52) U.S. Cl.
CPC ..... *G09G 3/3233* (2013.01); *G09G 3/2007* (2013.01); *G09G 3/2003* (2013.01);
(Continued)

(58) Field of Classification Search
None
See application file for complete search history.

(56) References Cited

U.S. PATENT DOCUMENTS 9,396,679 B2 7/2016 Kong et al.
10,262,570 B2 4/2019 Miyake
(Continued)

FOREIGN PATENT DOCUMENTS

CN 110021265 7/2019
JP 2016-167065 9/2016
(Continued)

OTHER PUBLICATIONS

Keunwoo Kim et al., "Double-Gate CMOS: Symmetrical-Versus Asymmetrical-Gate Devices", IEEE Transactions on Electron Devices, Feb. 2001, pp. 294-299, vol. 48, No. 2.
(Continued)

*Primary Examiner* — Matthew Yeung
(74) *Attorney, Agent, or Firm* — Kile Park Reed & Houtteman PLLC

(57) ABSTRACT

A display device includes a driving circuit that drives a pixel, and a display region including the pixel. The pixel includes a light emitting element electrically connected between a first power source and a second power source, a first transistor electrically connected between the first power source and the light emitting element to control a driving current, the first transistor including a first gate electrode electrically connected to a first node, and a second gate electrode electrically connected to a bias control line, and a switching transistor electrically connected between a data line and the first node, the switching transistor including a gate electrode electrically connected to a scan line. The driving circuit varies a control signal provided to the bias control line in a second period based on a first data signal provided to the data line during a first period.

17 Claims, 12 Drawing Sheets

(51) Int. Cl.
*G09G 3/3275* (2016.01)
*G09G 3/3266* (2016.01)

(52) U.S. Cl.
CPC ..... *G09G 3/3266* (2013.01); *G09G 3/3275* (2013.01); *G09G 2300/0426* (2013.01); *G09G 2310/08* (2013.01); *G09G 2320/0257* (2013.01)

(56) References Cited

U.S. PATENT DOCUMENTS

| | | | | |
|---|---|---|---|---|
| 2016/0300900 | A1* | 10/2016 | Miyake | G09G 3/3258 |
| 2019/0079330 | A1* | 3/2019 | Yamamoto | G02F 1/13454 |
| 2019/0355308 | A1* | 11/2019 | Verschueren | G09G 3/3225 |
| 2020/0135091 | A1* | 4/2020 | Kim | G09G 3/32 |
| 2021/0027719 | A1 | 1/2021 | Cho et al. | |
| 2021/0049958 | A1 | 2/2021 | Kim et al. | |

FOREIGN PATENT DOCUMENTS

| | | |
|---|---|---|
| KR | 10-2019-0103131 | 9/2019 |
| KR | 10-2021-0013488 | 2/2021 |
| KR | 10-2021-0019639 | 2/2021 |

OTHER PUBLICATIONS

In-Tak Cho et al., "Charge Trapping and Detrapping Characteristics in Amorphous InGaZnO TFTs Under Static and Dynamic Stresses", Semiconductor Science and Technology, 2009, pp. 1-6, vol. 24.

* cited by examiner

FIG. 9

| | Monitoring Gray (stressed by high grayscale) | | | | | | | |
|---|---|---|---|---|---|---|---|---|
| Monitoring Time (s) | 1 | 23 | 48 | 87 | 128 | 151 | 203 | 255 |
| 1 | 7.000 | 7.000 | 6.750 | 6.750 | 6.750 | 6.750 | 6.750 | 6.750 |
| 2 | 7.000 | 7.000 | 6.750 | 6.750 | 6.750 | 6.750 | 6.750 | 6.750 |
| 3 | 7.000 | 7.000 | 6.750 | 6.750 | 6.750 | 6.750 | 6.750 | 7.000 |
| 4 | 7.000 | 7.000 | 6.750 | 6.750 | 6.750 | 6.750 | 7.000 | 7.000 |
| 5 | 7.000 | 7.000 | 6.750 | 6.750 | 7.000 | 7.000 | 7.000 | 7.000 |
| 6 | 7.000 | 7.000 | 6.750 | 6.750 | 7.000 | 7.000 | 7.000 | 7.000 |
| 7 | 7.000 | 7.000 | 6.750 | 7.000 | 7.000 | 7.000 | 7.000 | 7.000 |
| 8 | 7.000 | 7.000 | 6.750 | 7.000 | 7.000 | 7.000 | 7.000 | 7.000 |
| 9 | 7.000 | 7.000 | 6.750 | 7.000 | 7.000 | 7.000 | 7.000 | 7.000 |
| 10 | 7.000 | 7.000 | 6.750 | 7.000 | 7.000 | 7.000 | 7.000 | 7.000 |
| 11 | 7.000 | 7.000 | 7.000 | 7.000 | 7.000 | 7.000 | 7.000 | 7.000 |
| 12 | 7.000 | 7.000 | 7.000 | 7.000 | 7.000 | 7.000 | 7.000 | 7.000 |
| 13 | 7.000 | 7.000 | 7.000 | 7.000 | 7.000 | 7.000 | 7.000 | 7.000 |
| 14 | 7.000 | 7.000 | 7.000 | 7.000 | 7.000 | 7.000 | 7.000 | 7.000 |
| 15 | 7.000 | 7.000 | 7.000 | 7.000 | 7.000 | 7.000 | 7.000 | 7.000 |

DISPLAY DEVICE AND METHOD OF DRIVING THE SAME

CROSS-REFERENCE TO RELATED APPLICATION

The application claims priority to and benefits of Korean Patent Application No. 10-2020-0000508 under 35 U.S.C. § 119, filed in the Korean Intellectual Property Office on Jan. 2, 2020, the entire contents of which are incorporated by reference.

BACKGROUND

1. Technical Field

Embodiments of the invention relate to a display device and a method of driving the same.

2. Description of the Related Art

A display device may display an image using pixels disposed in a display region. The pixels may be electrically connected to each scan line and data line, and may include transistors. For example, a pixel of an active light emitting display device may include a light emitting element, a driving transistor, and at least one switching transistor.

In order to express luminance at a desired level in the pixel, the driving current flowing through the driving transistor may be controlled quickly. However, due to the hysteresis characteristic of the driving transistor, the driving current may change along various paths (for example, through various current levels), and a difference may occur between driving currents of pixels expressing luminance of the same grayscale. The difference in current with respect to the change in grayscale can be visually recognized by a user as an afterimage (or a momentary afterimage).

It is to be understood that this background of the technology section is, in part, intended to provide useful background for understanding the technology. However, this background of the technology section may also include ideas, concepts, or recognitions that were not part of what was known or appreciated by those skilled in the pertinent art prior to a corresponding effective filing date of the subject matter disclosed herein.

SUMMARY

In order to reduce the hysteresis characteristic of a driving transistor, a channel width and length of the driving transistor, a capacitance of the capacitor, etc. may be designed differently, or a data voltage applied to a gate electrode of the driving transistor, a time when the data voltage is applied, and a light emitting time of the pixels may be adjusted. However, even in these cases, there may be a limit to reducing the duration of the afterimage, for example, to less than half.

An aspect of the invention may be to provide a display device capable of reducing an afterimage more effectively and a method of driving the same.

In order to achieve an aspect of the invention, a display device according to an embodiment may include a driving circuit that drives a pixel, and a display region including the pixel. The pixel may include a light emitting element electrically connected between a first power source and a second power source; a first transistor electrically connected between the first power source and the light emitting element to control a driving current, the first transistor including a first gate electrode electrically connected to a first node and a second gate electrode electrically connected to a bias control line, and a switching transistor electrically connected between a data line and the first node. The switching transistor may include a gate electrode electrically connected to a scan line. The driving circuit may vary a control signal provided to the bias control line in a second period based on a first data signal provided to the data line during a first period.

According to an embodiment, the driving circuit may control a voltage level of the control signal to be smaller than a voltage level of a reference control voltage when a first grayscale value corresponding to the first data signal is greater than a reference grayscale value, and the driving circuit may control the voltage level of the control signal to be greater than the voltage level of the reference control voltage when the first grayscale value is smaller than the reference grayscale value.

According to an embodiment, the driving circuit may control the voltage level of the control signal to be smaller than the reference control voltage when the first grayscale value is greater than the voltage level of the reference grayscale value and a second grayscale value corresponding to a second data signal provided to the data line in the second period is less than or equal to the reference grayscale value.

According to an embodiment, the driving circuit may control the voltage level of the control signal to be greater than the reference control voltage when the first grayscale value is smaller than the voltage level of the reference grayscale value, and the second grayscale value corresponding to the second data signal is greater than the reference grayscale value.

According to an embodiment, the first transistor may include a silicon semiconductor and may be a P-type transistor.

According to an embodiment, the first transistor may include a semiconductor pattern. The first gate electrode may be disposed on the semiconductor pattern with a first insulating layer disposed between the first gate electrode and the semiconductor pattern, the second gate electrode may be disposed under the semiconductor pattern with a second insulating layer disposed between the second gate electrode and the semiconductor pattern, a thickness of the second insulating layer may be greater than a thickness of the first insulating layer, and a threshold voltage of the first transistor may be varied according to the voltage level of the control signal applied to the second gate electrode.

According to an embodiment, the threshold voltage of the first transistor may be shifted in a positive direction when the voltage level of the control signal is decreased, and the threshold voltage level of the first transistor may be shifted in a negative direction when the voltage level of the control signal is increased.

According to an embodiment, the driving circuit may accumulate the first grayscale value during the first period to calculate a stress of the first transistor, and determine the voltage level of the control signal based on the stress and a second grayscale value corresponding to a second data signal provided to the data line in the second period.

According to an embodiment, the driving circuit may initialize and recalculate the stress with a predetermined period.

According to an embodiment, the control signal may have a fixed voltage level during the predetermined period.

According to an embodiment, the driving circuit may include a lookup table that stores voltage information of the control signal according to the second grayscale value.

According to an embodiment, the driving circuit may control the voltage level of the control signal to be equal to the voltage level of the reference control voltage when a difference between the first grayscale value and the reference grayscale value is smaller than a reference value.

According to an embodiment, the first transistor may include an oxide semiconductor, and the driving circuit may accumulate the first grayscale value corresponding to the first data signal to calculate a cumulative stress, and linearly vary the voltage level of the control signal as the cumulative stress increases.

In order to achieve an aspect of the invention, a display device according to an embodiment may include a first data line and a first bias control line that are disposed in a display region and extend in a first direction, and scan lines disposed in the display region and extending in a second direction crossing the first direction, and a first pixel and a second pixel that are disposed in the display region and electrically connected to the first data line and the first bias control line. Each of the first pixel and the second pixel may include a light emitting element electrically connected between a first power source and a second power source, a first transistor electrically connected between the first power source and the light emitting element to control a driving current, the first transistor including a first gate electrode electrically connected to a first node and a second gate electrode electrically connected to the first bias control line, and a switching transistor electrically connected between the first data line and the first node. The switching transistor may include a gate electrode electrically connected to a corresponding scan line among the scan lines.

According to an embodiment, the display device may further include a driving circuit that drives the first pixel and the second pixel. The driving circuit may vary a control signal provided to the first bias control line in a second period based on a first data signal provided to the first data line during a first period.

According to an embodiment, the display device may further include a second data line and a second bias control line that may be disposed in the display region and extend in the first direction, respectively, and a third pixel electrically connected to the second data line and the second bias control line. The third pixel may be disconnected to the first bias control line.

In order to achieve an aspect of the invention, in a method of driving a display device according to an embodiment, the display device may include a pixel having a driving transistor.

The method of driving the display device may include calculating a stress of the pixel based on a first data signal provided to a first gate electrode of the driving transistor during a first period; and varying a voltage level of a control signal provided to a second gate electrode of the driving transistor in a second period based on the stress and a second data signal provided to the first gate electrode in the second period.

According to an embodiment, the driving transistor may include a silicon semiconductor and may be a P-type transistor.

According to an embodiment, the varying the voltage level of the control signal may include controlling the voltage level of the control signal to be smaller than a voltage level of a reference control voltage when a first grayscale value corresponding to the first data signal is greater than a reference grayscale value, and controlling the voltage level of the control signal to be greater than the voltage level of the reference control voltage when the first grayscale value is smaller than the reference grayscale value.

According to an embodiment, the varying the voltage level of the control signal may include controlling the voltage level of the control signal to be smaller than the voltage level of the reference control voltage when the first grayscale value is greater than the reference grayscale value and a second grayscale value corresponding to the second data signal is less than or equal to the reference grayscale value, and controlling the voltage level of the control signal to be greater than the reference control voltage when the first grayscale value is smaller than the voltage level of the reference grayscale value and the second grayscale value corresponding to the second data signal is greater than the reference grayscale value.

BRIEF DESCRIPTION OF THE DRAWINGS

The accompanying drawings, which are included to provide a further understanding of the inventive concepts, and are incorporated in and constitute a part of this specification, illustrate exemplary embodiments of the inventive concepts, and, together with the description, serve to explain principles of the inventive concepts.

FIG. 9 is a schematic diagram illustrating an example of a lookup table used in the timing controller of FIG. 7.

DETAILED DESCRIPTION OF THE EMBODIMENTS

Figure 1:
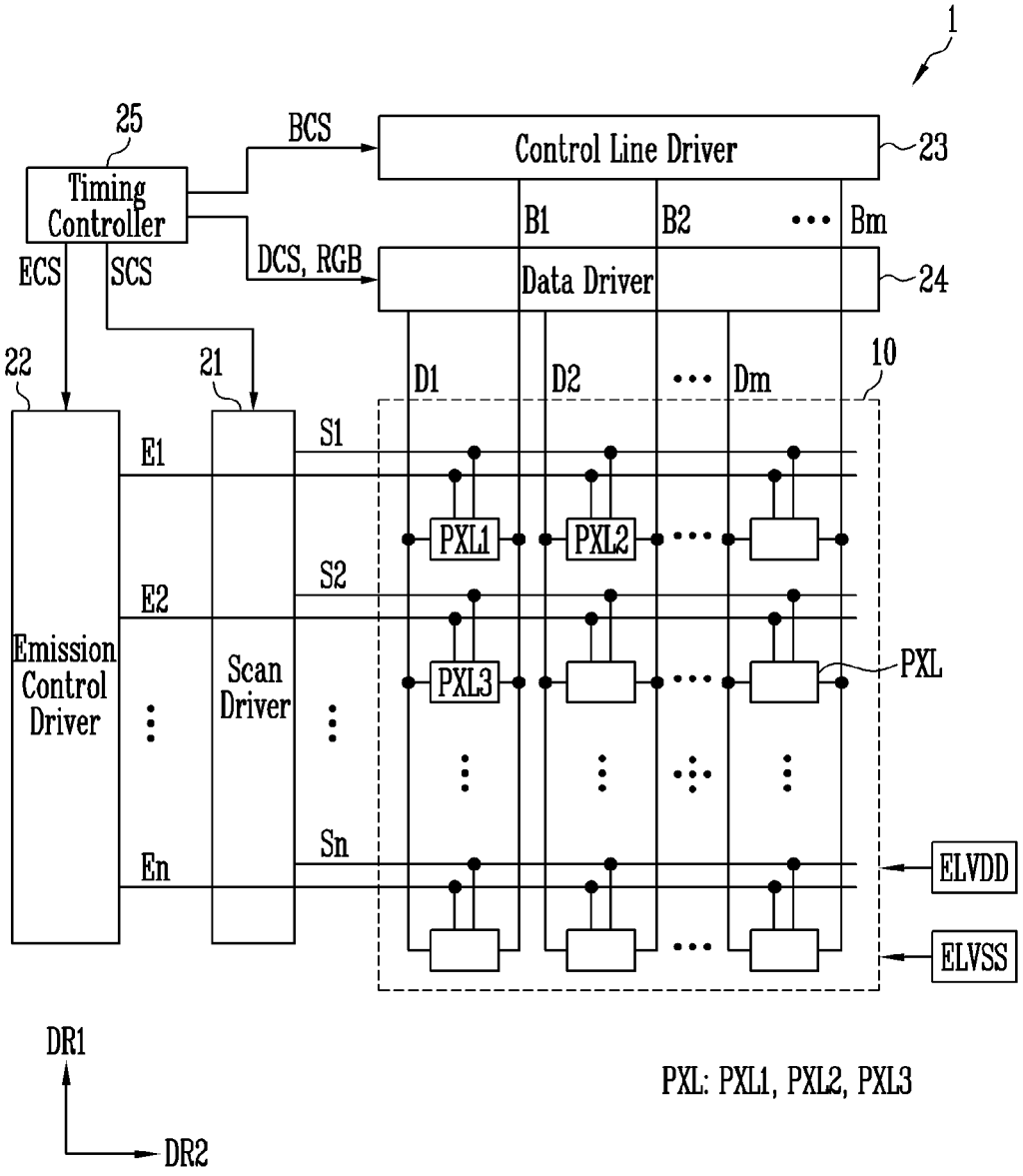
FIG. 1 is a schematic block diagram illustrating a display device according to an embodiment of the invention.

Hereinafter, various embodiments of the invention are described in detail with reference to the accompanying drawings so that those skilled in the art may easily practice the invention. The invention may be implemented in various different forms and is not limited to the embodiments described in the specification.

In order to clearly describe the invention, parts irrelevant to the description may be omitted. The same or similar components are denoted by the same reference numerals throughout the specification. Therefore, the reference numerals described above may be used in other drawings.

The term "and/or" is intended to include any combination of the terms "and" and "or" for the purpose of its meaning and interpretation. For example, "A and/or B" may be understood to mean "A, B, or A and B." The terms "and" and "or" may be used in the conjunctive or disjunctive sense and may be understood to be equivalent to "and/or."

The phrase "at least one of" is intended to include the meaning of "at least one selected from the group of" for the purpose of its meaning and interpretation. For example, "at least one of A and B" may be understood to mean "A, B, or A and B."

The size and thickness of each component illustrated in the drawings may be arbitrarily shown for convenience of description. Therefore, the invention is not necessarily limited to that illustrated in the drawings. In the drawings, the thicknesses of the various layers and regions may be exaggerated for clarity.

Terms such as "overlap" may include layer, stack, face or facing, extending over, covering or partly covering or any other suitable term as would be appreciated and understood by those of ordinary skill in the art.

"About" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" may mean within one or more standard deviations, or within ±30%, 20%, 5% of the stated value.

Unless otherwise defined, all terms used herein (including technical and scientific terms) have the same meaning as commonly understood by those skilled in the art to which this disclosure pertains. It will be further understood that terms, such as those defined in commonly used dictionaries, should be interpreted as having a meaning that is consistent with their meaning in the context of the relevant art and will not be interpreted in an ideal or excessively formal sense unless clearly defined in the specification.

FIG. 1 is a schematic block diagram illustrating a display device according to an embodiment of the invention.

Referring to FIG. 1, a display device 100 may include pixels PXL disposed in a display region 10 and driving circuits 21 to 25 for driving the pixels PXL.

The display region 10 may include scan lines S1 to Sn, emission control lines E1 to En, bias control lines B1 to Bm, data lines D1 to Dm, and pixels PXL. The pixels PXL may be electrically connected to the scan lines S1 to Sn, the emission control lines E1 to En, the bias control lines B1 to Bm, and the data lines D1 to Dm. In describing embodiments of the invention, the term "connection" may broadly mean an electrical connection and/or a physical connection. For example, the pixels PXL may be electrically connected to the scan lines S1 to Sn, the emission control lines E1 to En, the bias control lines B1 to Bm, and the data lines D1 to Dm.

According to an embodiment, each of the scan lines S1 to Sn and the emission control lines E1 to En may extend in a horizontal direction (also referred to as a row direction or a second direction DR2) in the display region 10, and may be commonly electrically connected to the pixels PXL (for example, a first pixel PXL1 and a second pixel PXL2) positioned on each horizontal line (also referred to as a pixel row). Each of the data lines D1 to Dm and the bias control lines B1 to Bm may extend in a vertical direction (also referred to as a column direction or a first direction DR1) in the display region 10 so as to intersect the scan lines S1 to Sn and the emission control lines E1 to En, and may be commonly electrically connected to the pixels PXL (for example, the first pixel PXL1 and a third pixel PXL3) positioned on each vertical line (also referred to as a pixel column).

In an embodiment, the emission control lines E1 to En may be omitted. For example, the emission control lines E1 to En may be selectively provided according to the structure and/or driving method of the pixels PXL. According to an embodiment, the pixels PXL may be further electrically connected to at least one other control line (not shown), and the operation of the pixels PXL may be controlled by a control signal supplied from the control line.

The pixels PXL may receive respective scan signals (first gate signals), emission control signals, control signals having a predetermined voltage (also referred to as bias control signals, back-bias voltages, second gate signals, or second gate voltages) and data signals from the scan lines S1 to Sn, the emission control lines E1 to En, the bias control lines B1 to Bm, and the data lines D1 to Dm. The pixels PXL may further receive driving power such as a first power source ELVDD and a second power source ELVSS. The pixels PXL may further receive other driving power source (for example, an initialization power source) according to the structure and/or driving method of the pixels PXL.

The pixels PXL may receive the data signals from the data lines D1 to Dm when the scan signals are supplied from the scan lines S1 to Sn, and emit light at luminance corresponding to the data signals. Accordingly, an image corresponding to a data signal of each frame may be displayed in the display region 10.

In an embodiment, emission periods of the pixels PXL may be controlled by the emission control signals supplied from the emission control lines E1 to En, respectively. Driving current flowing through the pixels PXL may be controlled by the control signals supplied from the bias control lines B1 to Bm together with the data signals.

Each of the pixels PXL may include a light emitting element and a pixel circuit for driving the light emitting element. The pixel circuit may control the driving current flowing from the first power source ELVDD to the second power source ELVSS via the light emitting element in response to the data signal. To this end, the pixel circuit may include a driving transistor, at least one switching transistor, and a storage capacitor.

The driving circuits 21 to 25 may include drivers for supplying driving signals to the pixels PXL. For example, the driving circuits 21 to 25 may include a scan driver 21 for supplying the scan signals to the scan lines S1 to Sn, an emission control driver 22 for supplying the emission control signals to the emission control lines E1 to En, a control line driver 23 for supplying the control signals having a predetermined voltage to the bias control lines B1 to Bm, a data driver 24 for supplying the data signals to the data lines D1 to Dm, and a timing controller 25 for controlling the scan driver 21, the emission control driver 22, the control line driver 23, and the data driver 24.

The scan driver 21 may receive a scan drive control signal SCS from the timing controller 25 and supply the scan signals to the scan lines S1 to Sn in response to the scan drive control signal SCS. For example, the scan driver 21 may sequentially supply the scan signals to the scan lines S1 to Sn in response to the scan drive control signal SCS. When the scan signals are supplied to the scan lines S1 to Sn, the pixels PXL electrically connected to the scan lines to which the scan signals may be supplied may be selected to receive the data signals from the data lines D1 to Dm.

According to an embodiment, the scan signals may be used to select the pixels PXL in units of horizontal lines. For example, the scan signals may have a gate-on voltage (for example, a low voltage) at which a transistor of each pixel PXL connected to the data lines D1 to Dm may be turned on, and may be supplied to the pixels PXL of the horizontal line corresponding to each horizontal period. The pixels PXL receiving the scan signals may be electrically connected to the data lines D1 to Dm during a period in which the scan signals may be supplied, to receive the data signals.

The emission control driver 22 may receive an emission drive control signal ECS from the timing controller 25 and supply the emission control signals to the emission control lines E1 to En in response to the emission drive control signal ECS. For example, the emission control driver 22 may sequentially supply the emission control signals to the emission control lines E1 to En in response to the emission drive control signal ECS. The emission control driver 22 may be selectively provided according to the structure and/or driving method of the pixels PXL, and may be omitted according to embodiments.

The emission control signals may be used to control the emission periods (for example, emission timing and/or emission duration) of the pixels PXL. For example, the emission control signals may have a gate-off voltage (for example, a high voltage) in which at least one transistor disposed on a current path of each of the pixels PXL may be turned off. A pixel PXL receiving an emission control signal may be set to a non-light emitting state during a period in which the emission control signal may be supplied, and may be set to a light emitting state during another period. On the other hand, when a data signal corresponding to a black grayscale is supplied to a specific pixel PXL, the pixel PXL may maintain the non-light emitting state corresponding to the data signal even when the emission control signal having the gate-off voltage may not be supplied.

The control line driver 23 may receive a bias drive control signal BCS from the timing controller 25 and supply the control signals having a predetermined voltage to the bias control lines B1 to Bm in response to the bias drive control signal BCS. For example, the control line driver 23 may supply the control signals having the same voltage or different voltages to the bias control lines B1 to Bm in response to the bias drive control signal BCS. For example, the control line driver 23 may supply the control signals having a predetermined voltage and/or waveform to the bias control lines B1 to Bm of the pixels PXL during the emission periods of the pixels PXL disposed on each vertical line.

The control signals output from the control line driver 23 may be used to control the characteristic of the driving transistor included in the pixels PXL. For example, the control signal may be supplied to a second gate electrode of the driving transistor included in each pixel PXL to control a threshold voltage of the driving transistor. When the threshold voltage of the driving transistor is changed using the control signal, the magnitude of the driving current generated by the driving transistor for each data signal may be adjusted. Therefore, the luminance of the pixels PXL can be controlled by controlling the voltage (or voltage level) of the control signals.

The data driver 24 may receive a data drive control signal DCS and image data RGB from the timing controller 25, and supply the data signals to the data lines D1 to Dm in response to the data drive control signal DCS and the image data RGB. The data signals supplied to the data lines D1 to Dm may be supplied to the pixels PXL selected by the scan signals.

The timing controller 25 may receive input image data from outside and rearrange the input image data to generate the image data RGB. The timing controller 25 may supply the image data RGB to the data driver 24. The image data RGB supplied to the data driver 24 may be used to generate the data signals to be supplied to the pixels PXL.

The timing controller 25 may receive various timing signals (for example, a vertical/horizontal synchronization signal, a main clock signal, etc.) from an external device (for example, a host processor), and generate the scan drive control signal SCS, the emission drive control signal ECS, the bias drive control signal BCS, and the data drive control signal DCS in response to the timing signals. The scan drive control signal SCS, the emission drive control signal ECS, the bias drive control signal BCS, and the data drive control signal DCS may be supplied to the scan driver 21, the emission control driver 22, the control line driver 23, and the data driver 24, respectively.

The scan drive control signal SCS may include a first start pulse (for example, a scan start pulse) and a first clock signal (for example, at least one scan clock signal). The first start pulse may control output timing of a first scan signal (for example, the scan signal supplied to a first scan line S1), and the first clock signal may be used to sequentially shift the first start pulse.

The emission drive control signal ECS may include a second start pulse (for example, an emission start pulse) and a second clock signal (for example, at least one emission clock signal). The second start pulse may control output timing of a first emission control signal (for example, the emission control signal supplied to a first emission control line E1), and the second clock signal may be used to sequentially shift the second start pulse.

The bias drive control signal BCS may control the control line driver 23 to output the control signals having a predetermined voltage in a second period according to stresses (or stress values) of the pixels PXL in a first period. Here, the stresses of the pixels PXL may indicate stresses of the driving transistors included in the pixels PXL. For example, the stress of the pixel PXL may indicate the direction and/or magnitude in which the threshold voltage of the driving transistor may be shifted by the data signal applied to a gate electrode (or a first gate electrode) of the driving transistor.

In an embodiment, the timing controller 25 may calculate the stress (or the stress value) of the pixel PXL based on the data signal (or a grayscale value corresponding to the data signal and included in the image data RGB) provided to the pixel PXL during a reference time (or during the first period), and generate the bias drive control signal BCS based on the stress of the pixel PXL. For example, the timing controller 25 may accumulate grayscale values (or integrate the data signals) corresponding to the first pixel PXL1 for several tens of seconds (for example, for ten seconds) to calculate a first stress of the first pixel PXL1, and determine a voltage of the control signal to be applied to the first bias control line D1 based on the first stress of the first pixel PXL1. For example, when the first stress of the first pixel PXL1 is greater than a reference stress, the timing controller 25 may determine the voltage of the control signal to be applied to the first bias control line D1 to be smaller than a reference control voltage. When the threshold voltage of the driving transistor in the first pixel PXL1 is shifted in a negative direction by the first stress, the threshold voltage of the driving transistor may be shifted again in a positive direction by the voltage of the relatively low control signal. As a result, the first pixel PXL1 may emit light at a desired luminance without an afterimage. As another example, when the first stress of the first pixel PXL1 is smaller than the reference stress, the timing controller 25 may determine the voltage of the control signal to be applied to the first bias control line D1 to be greater than the reference control voltage. When the threshold voltage of the driving transistor in the first pixel PXL1 is shifted in the positive direction by the first stress, the threshold voltage of the driving transistor may be shifted again in the negative direction by the voltage of the relatively high control signal. As a result, the first pixel PXL1 may emit light at the desired luminance without the afterimage.

Similarly, the timing controller 25 may accumulate grayscale values corresponding to the second pixel PXL2 for several tens of seconds to calculate a second stress of the second pixel PXL2, and determine the voltage of the control signal to be applied to a second bias control line D2 based on the second stress of the second pixel PXL2. The bias drive control signal BCS may include the voltage of the control signal to be applied to the first bias control line D1, the voltage of the control signal to be applied to the second bias control line D2, and the like.

A configuration of determining the voltage of the control signal will be described later with reference to FIGS. 5A and 7.

The data drive control signal DCS may include a source sampling pulse, a source sampling clock, and a source output enable signal. The data drive control signal DCS may control sampling operation of data.

As described with reference to FIG. 1, the display device 1 may include the bias control lines B1 to Bm electrically connected to the pixels PXL positioned on the vertical line and extending in the first direction DR1, and the control line driver 23 to provide the control signals to the bias control lines B1 to Bm. The display device 1 (or the timing controller 25) may calculate the stress of the pixel PXL (or the stress of the driving transistor in the pixel PXL) based on the data signal (or the grayscale value corresponding to the data signal) applied to the pixel PXL (for example, the first pixel PXL1) for a predetermined time, and vary the voltage of the control signal based on the stress of the pixel PXL. As the threshold voltage of the driving transistor in the pixel PXL may be shifted by the control signal, the pixel PXL may emit light at the desired luminance without the afterimage, and image quality of the display device 1 may be improved.

Figure 2:
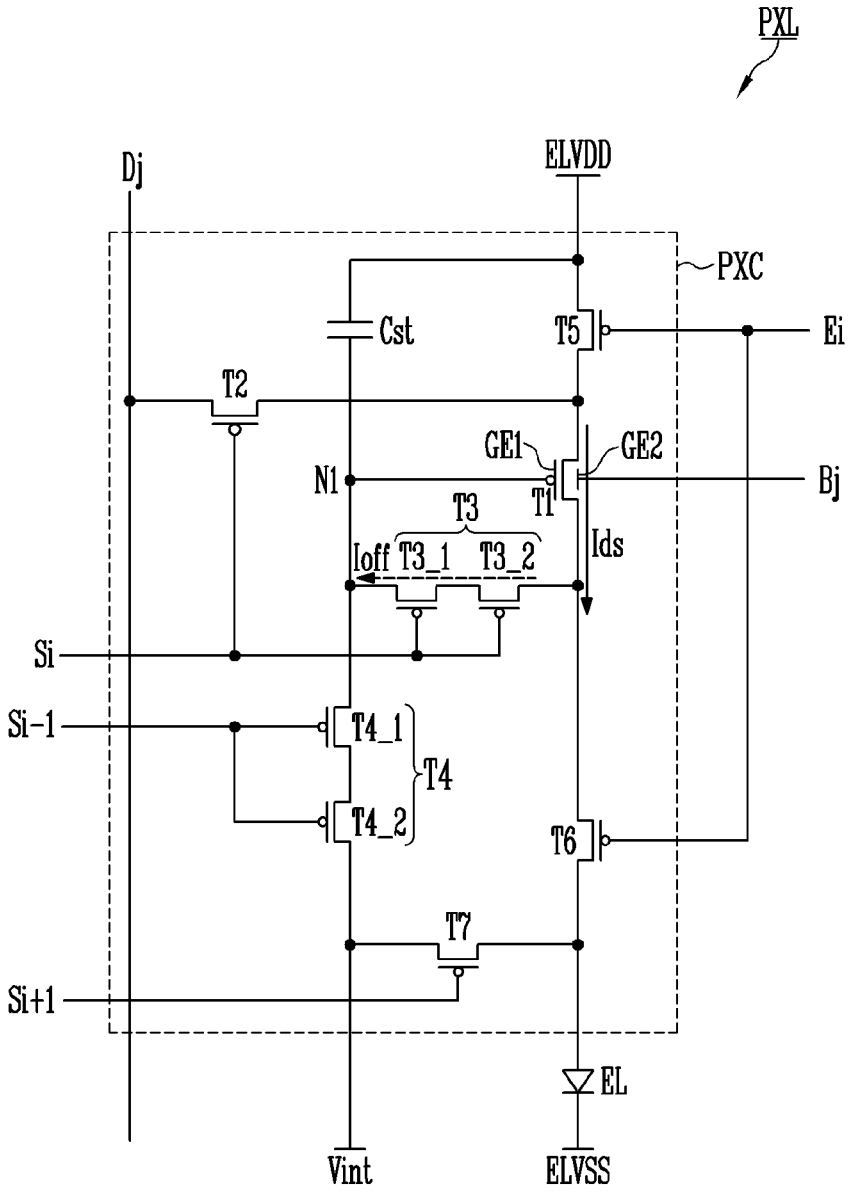
FIG. 2 is a schematic circuit diagram illustrating an example of a pixel included in the display device of FIG. 1.

FIG. 2 is a schematic circuit diagram illustrating an example of a pixel included in the display device of FIG. 1.

A pixel PXL illustrated in FIG. 2 may be disposed in an i-th pixel row (for example, an i-th horizontal line) and a j-th pixel column (for example, a j-th vertical line) of the display region 10, and electrically connected to an i-th scan line Si, an i-th emission control line Ei, a j-th bias control line Bj, and a j-th data line Dj, where i and j may be positive integers. The pixel PXL may be further selectively electrically connected to at least one other scan line or control line. For example, the pixel PXL may be further electrically connected to an (i−1)th scan line Si−1 and an (i+1)th scan line Si+1.

The pixels PXL disposed in the display region 10 of FIG. 1 may have substantially the same structure. Hereinafter, the i-th scan line Si, the i-th emission control line Ei, the j-th bias control line Bj and the j-th data line Dj will be referred to as a scan line Si, an emission control line Ei, a bias control line Bj, and a data line Dj, respectively.

Referring to FIG. 2, the pixel PXL may include a light emitting element EL and a pixel circuit PXC for driving the light emitting element EL. According to an embodiment, the light emitting element EL may be electrically connected between the pixel circuit PXC and the second power source ELVSS, but the position of the light emitting element EL is not limited thereto. For example, in another embodiment, the light emitting element EL may be electrically connected between the first power source ELVDD and the pixel circuit PXC.

According to an embodiment, the light emitting element EL may be an organic light emitting diode (OLED) including an organic light emitting layer, but the invention is not limited thereto. For example, in another embodiment, ultra-small inorganic light emitting elements as small as nanoscale to microscale may constitute a light source of each pixel PXL.

The light emitting element EL may be electrically connected between the first power source ELVDD and the second power source ELVSS. For example, an anode electrode of the light emitting element EL may be electrically connected to the first power source ELVDD via the pixel circuit PXC, and a cathode electrode of the light emitting element EL may be electrically connected to the second power source ELVSS. The light emitting element EL may emit light having luminance corresponding to a driving current Ids when the driving current Ids may be supplied from a first transistor T1.

The first power source ELVDD and the second power source ELVSS may have a potential difference that allows the light emitting element EL to emit light. For example, the first power source ELVDD may be a high potential pixel power source, and the second power source ELVSS may be a low potential pixel power source having a potential as low as a threshold voltage of the light emitting element EL in the first power source ELVDD.

The pixel circuit PXC may include a driving transistor, at least one switching transistor, and a storage capacitor Cst. For example, the pixel circuit PXC may include the first transistor T1 as the driving transistor, second to seventh transistors T2 to T7 as the switching transistors, and the storage capacitor Cst. At least one switching transistor among the switching transistors, for example, the second transistor T2 and the third transistor T3 may be electrically connected between the data line Dj and a first node N1 and may have gate electrodes electrically connected to the scan line Si. The second transistor T2 and the third transistor T3 may be provided to transfer a voltage of the data signal to the first node N1. For example, the second transistor T2 and the third transistor T3 may be turned on at the same time by the scan signal of the gate-on voltage to transfer a voltage corresponding to the voltage difference between the voltage of the data signal and the threshold voltage of the first transistor T1 to the first node N1.

The first transistor T1 may be electrically connected between the first power source ELVDD and the second power source ELVSS to be positioned on a current path of the driving current Ids to control the driving current Ids. For example, the first transistor T1 may be electrically connected between the first power source ELVDD and the light emitting element EL. For example, a first electrode (for example, a source electrode) of the first transistor T1 may be electrically connected to the first power source ELVDD via the fifth transistor T5 and a second electrode (for example, a drain electrode) of the first transistor T1 may be electrically connected to the light emitting element EL via the sixth transistor T6.

According to an embodiment, the first transistor T1 may be a transistor having a dual gate structure. For example, the first transistor T1 may include a first gate electrode GE1 electrically connected to the first node N1 and a second gate electrode GE2 electrically connected to the bias control line Bj.

In an embodiment of the invention, the first gate electrode GE1 of the first transistor T1 may be disposed closer to a channel region than the second gate electrode GE2. The first transistor T1 may control a voltage of the first node N1 applied to the first gate electrode GE1 to express respective grayscales. The first transistor T1 may control the driving current Ids flowing through the light emitting element EL in response to a first gate voltage, for example, the voltage of the first node N1. For example, the first transistor T1 may control the driving current Ids flowing from the first power source ELVDD to the second power source ELVSS via the light emitting element EL in response to the voltage of the first node N1 during an emission period of each frame.

The control signal having a predetermined voltage may be applied to the second gate electrode GE2 of the first transistor T1 through the bias control line Bj. The voltage of the control signal may affect the threshold voltage of the first transistor T1. For example, when the first transistor T1 is a P-type transistor, as the voltage applied to the second gate electrode GE2 decreases, the threshold voltage of the first transistor T1 may increase. On the contrary, as the voltage applied to the second gate electrode GE2 increases, the threshold voltage of the first transistor T1 may decrease. Therefore, the characteristic of the first transistor T1 may be adjusted by controlling the voltage of the control signal supplied to the bias control line Bj.

The second transistor T2 may be electrically connected between the data line Dj and the first electrode of the first transistor T1. A gate electrode of the second transistor T2 may be electrically connected to the scan line Si.

The second transistor T2 may be turned on to electrically connect the data line Dj to the first electrode of the first transistor T1 when the scan signal having the gate-on voltage is supplied to the scan line Si. Therefore, when the second transistor T2 is turned on, the data signal from the data line Dj may be transferred to the first electrode of the first transistor T1.

During a period in which the second transistor T2 is turned on by the scan signal, the third transistor T3 may also be turned on by the scan signal, and the first transistor T1 may be turned on by the third transistor T3 to be electrically connected in the form of a diode. Accordingly, the data signal from the data line Dj may be transferred to the first node N1 via the second transistor T2, the first transistor T1, and the third transistor T3. A voltage corresponding to the data signal and the threshold voltage of the first transistor T1 may be transferred to the first node N1, and the voltage transferred to the first node N1 may be stored in the storage capacitor Cst.

The third transistor T3 may be electrically connected between the second electrode of the first transistor T1 and the first node N1. A gate electrode of the third transistor T3 may be electrically connected to the scan line Si. The third transistor T3 may be turned on to electrically connect the second electrode of the first transistor T1 to the first node N1 when the scan signal having the gate-on voltage is supplied to the scan line Si. Therefore, when the third transistor T3 is turned on, the first transistor T1 may be electrically connected in the form of a diode.

In an embodiment, the third transistor T3 may be composed of transistors electrically connected in series to reduce a leakage current Ioff flowing in an off state. For example, the third transistor T3 may include a third_1 transistor T3_1 and a third_2 transistor T3_2 electrically connected in series between the first node N1 and the second electrode of the first transistor T1. Gate electrodes of the third_1 transistor T3_1 and the third_2 transistor T3_2 may be commonly electrically connected to the scan line Si. Accordingly, the third_1 transistor T3_1 and the third_2 transistor T3_2 may be turned on or turned off at the same time in response to the scan signal.

The fourth transistor T4 may be electrically connected between the first node N1 and the initialization power source Vint. A gate electrode of the fourth transistor T4 may be electrically connected to the (i−1)th scan line Si−1. According to an embodiment, the (i−1)th scan line Si−1 may be a scan line for selecting the pixels PXL of an (i−1)th horizontal line to supply the data signal, and may also be used as an initialization control line for initializing the pixels PXL of the i-th horizontal line. However, the invention is not limited thereto. For example, in another embodiment, the gate electrode of the fourth transistor T4 may be electrically connected to another one scan line (for example, an (i−2)th scan line Si−2) among the previous scan lines for selecting the pixels PXL of the previous horizontal lines, or may be electrically connected to a control line formed separately from the scan lines S1 to Sn of the pixels PXL. The fourth transistor T4 may be driven by a signal supplied from another one scan line or the separate control line.

The fourth transistor T4 may be turned on when the scan signal of the gate-on voltage (hereinafter, referred to as a previous scan signal) is supplied to the (i−1)th scan line Si−1. When the fourth transistor T4 is turned on, a voltage of the initialization power source Vint may be transferred to the first node N1, and accordingly, the voltage of the first node N1 may be initialized to the voltage of the initialization power source Vint.

The voltage of the initialization power source Vint may be set to a voltage less than or equal to the voltage of the data signal. For example, the voltage of the initialization power source Vint may be set below the lowest voltage of the data signal. When the voltage of the first node N1 is initialized to the voltage of the initialization power source Vint before the data signal of the current frame is transferred to each pixel PXL, the first transistor T1 may be electrically connected in the form of a forward diode during a scan period of each horizontal line regardless of the data signal of the previous frame. Accordingly, the data signal of the current frame can be stably transferred to the first node N1 regardless of the data signal of the previous frame.

In an embodiment, the fourth transistor T4 may be composed of transistors electrically connected in series to reduce a leakage current. For example, the fourth transistor T4 may include a fourth_1 transistor T4_1 and a fourth_2 transistor T4_2 electrically connected in series between the first node N1 and the initialization power source Vint. Gate electrodes of the fourth_1 transistor T4_1 and the fourth_2 transistor T4_2 may be commonly electrically connected to the (i−1)th scan line Si−1. Accordingly, the fourth_1 transistor T4_1 and the fourth_2 transistor T4_2 may be turned on or turned off at the same time in response to the previous scan signal.

When the third transistor T3 and the fourth transistor T4 are configured as multiple transistors having at least a dual structure, the leakage current of each of the third transistor T3 and the fourth transistor T4 can be reduced. Accordingly, the leakage current through the third transistor T3 and the fourth transistor T4 in an off state during the emission period of each frame can be reduced, and the voltage variation of the first node N1 can be reduced.

Figure 3:
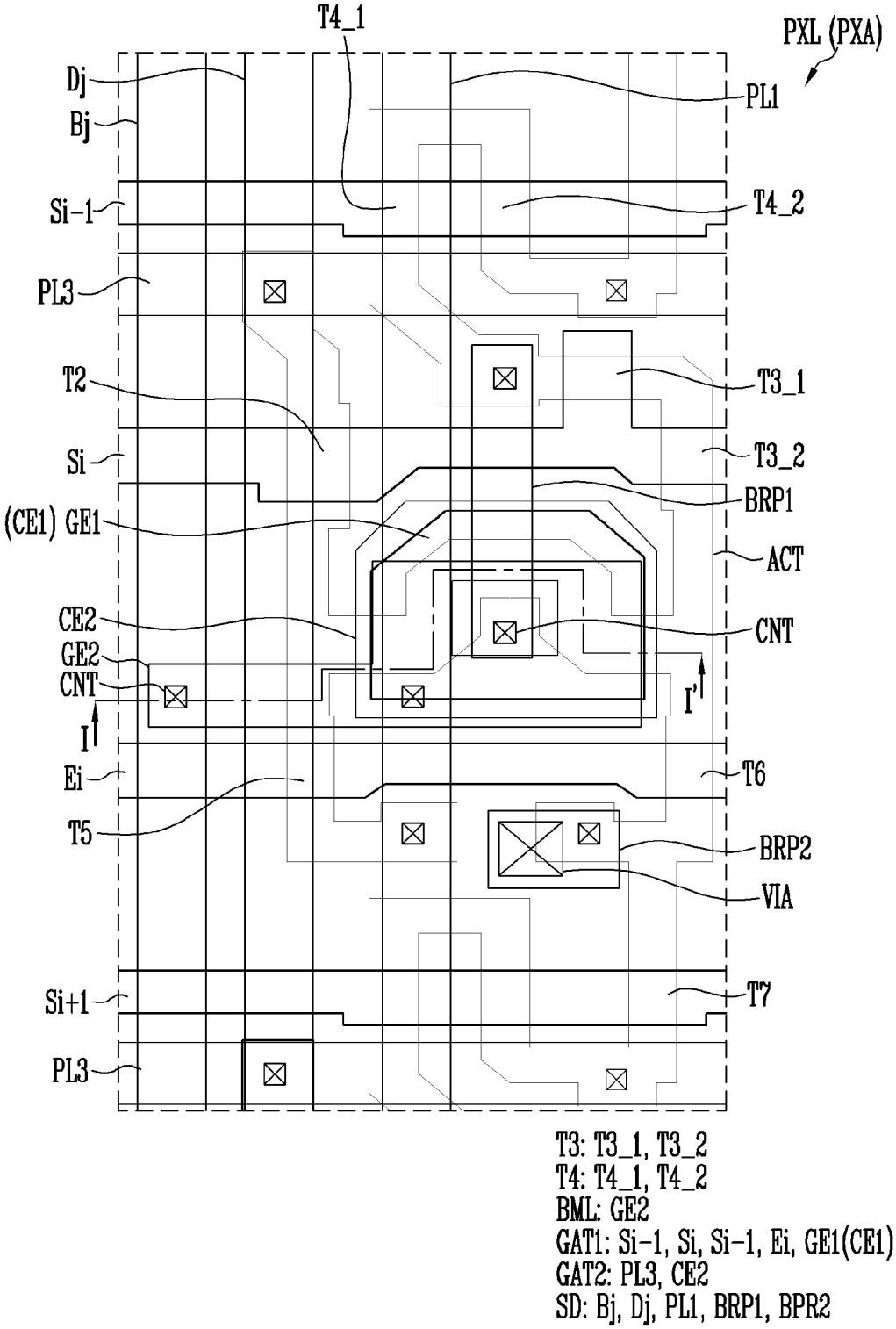
FIG. 3 is a schematic plan view illustrating an example of the pixel of FIG. 2.

FIGS. 2 and 3 illustrate the embodiment in which each of the third and fourth transistors T3 and T4 may be configured as the transistor having the dual structure, but the invention is not limited thereto. For example, in another embodiment, only one transistor (for example, the third transistor T3) of the third transistor T3 and the fourth transistor T4 may be formed of the multiple transistors, and another transistor (for example, the fourth transistor T4) may be formed of a single transistor. In another embodiment, as switching transistors other than the third transistor T3 and the fourth transistor T4, for example, the second transistor T2 and at least one transistor among the fifth to seventh transistors T5 to T7 may be formed of the multiple transistors including transistors electrically connected in series.

The fifth transistor T5 may be electrically connected between the first power source ELVDD and the first transistor T1. A gate electrode of the fifth transistor T5 may be electrically connected to the emission control line Ei. The fifth transistor T5 may be turned off when the emission control signal of the gate-off voltage is supplied to the emission control line Ei, and may be turned on in other cases.

The sixth transistor T6 may be electrically connected between the first transistor T1 and the light emitting element EL. A gate electrode of the sixth transistor T6 may be electrically connected to the emission control line Ei. The sixth transistor T6 may be turned off when the emission control signal of the gate-off voltage is supplied to the emission control line Ei, and may be turned on in other cases.

That is, the fifth and sixth transistors T5 and T6 may be simultaneously turned on or turned off by the emission control signal to control the emission period of the pixels PXL. When the fifth and sixth transistors T5 and T6 are turned on, a current path through which the driving current Ids flows may be formed in the pixel PXL. Accordingly, the pixel PXL may emit light at a luminance corresponding to the voltage of the first node N1. On the contrary, when the fifth and sixth transistors T5 and T6 are turned off, the current path may be blocked and the pixel PXL may not emit light.

According to an embodiment, the emission control signal may be supplied as the gate-off voltage to turn off the fifth and sixth transistors T5 and T6 during an initialization period and a data programming period (for example, the scan period) of the pixel PXL. For example, the emission control signal of the gate-off voltage may be supplied to overlap the scan signal (and the previous scan signal) of the gate-on voltage. After the voltage of the scan signal is changed to the gate-off voltage, the voltage of the emission control signal may be changed to the gate-on voltage. Accordingly, the data signal may be stably stored in the pixel PXL before the emission period of each frame.

The seventh transistor T7 may be electrically connected between the initialization power source Vint and one electrode (for example, the anode electrode) of the light emitting element EL. A gate electrode of the seventh transistor T7 may be electrically connected to the (i+1)th scan line Si+1. According to an embodiment, the (i+1)th scan line Si+1 may be a scan line for selecting the pixels PXL of an (i+1)th horizontal line to supply the data signal. The (i+1)th scan line Si+1 may also be used as a bypass control line for initializing charges charged in organic capacitors (parasitic capacitor generated due to the structure of the light emitting element EL) formed in the light emitting elements EL of the pixels PXL positioned on the i-th horizontal line. However, the invention is not limited thereto. For example, in another embodiment, the gate electrode of the seventh transistor T7 may be electrically connected to the current scan line (that is, the scan line Si), another one scan line (for example, an (i+2)th scan line Si+2) among the next scan lines for selecting the pixels PXL of the next horizontal lines, or the control line formed separately from the scan lines S1 to Sn of the pixels PXL. The seventh transistor T7 may be driven by a signal supplied from the current scan line Si, another one scan line, or the separate control line.

The seventh transistor T7 may be turned on when the scan signal (hereinafter, referred to as a next scan signal) of the gate-on voltage is supplied to the (i+1)th scan line Si+1 before each emission period so that the voltage of the initialization power source Vint may be transferred to one electrode of the light emitting element EL. Accordingly, the pixel PXL may exhibit more uniform luminance characteristic for each data signal.

The storage capacitor Cst may be electrically connected between the first power source ELVDD and the first node N1. The voltage corresponding to the data signal and the threshold voltage of the first transistor T1 may be charged in the storage capacitor Cst.

As in the above-described embodiment, each pixel PXL may include transistors such as the driving transistor (the first transistor T1) and at least one switching transistor (for example, at least one of the second to seventh transistors T2 to T7). In an embodiment, the transistors may be transistors having similar structures, sizes, and/or types. In another embodiment, at least one of the transistors may be a transistor having a structure, a size, and/or a type different from the remaining transistors. For example, the first transistor T1 may be a transistor having the dual gate structure, and each of the second to seventh transistors T2 to T7 may be a transistor having a single gate structure.

The structure of the pixel circuit PXC may be variously changed according to embodiments. For example, the pixel PXL may include the pixel circuit PXC having various known structures and/or driving methods.

In the embodiment of FIG. 2, each transistor is illustrated as the P-type transistor. However, the invention is not limited thereto. For example, at least one of the first to seventh transistors T1 to T7 may be an N-type transistor. The gate-on voltage for turning on the N-type transistor may be the high voltage.

The voltage of the data signal may be determined according to the type of the first transistor T1. For example, when the first transistor T1 is the P-type transistor, as the grayscale to be expressed may be higher, the data signal having a lower voltage may be supplied to each pixel PXL. When the first transistor T1 is the N-type transistor, as the grayscale to be expressed may be higher, the data signal having a higher voltage may be supplied to each pixel PXL.

That is, in various embodiments of the invention, the types of transistors constituting the pixel PXL and the voltage levels of various control signals for controlling the transistors may vary according to embodiments.

FIG. 3 is a schematic plan view illustrating an example of the pixel of FIG. 2. FIG. 3 illustrates the pixel PXL centering on the pixel circuit PXC of the pixel PXL of FIG. 2.

Referring to FIG. 3, the pixel PXL may include a semiconductor layer ACT, a first conductive layer BML, a second conductive layer GAT1, a third conductive layer GAT2, and a fourth conductive layer SD. The semiconductor layer ACT, the first conductive layer BML, the second conductive layer GAT1, the third conductive layer GAT2, and the fourth conductive layer SD may be formed on different layers through different processes. This will be described later with reference to FIG. 4.

The first conductive layer BML may include the second gate electrode GE2. The second gate electrode GE2 may have a predetermined area and may be generally positioned at a central portion of a first circuit region A_PXC1. The second gate electrode GE2 may overlap a horizontal portion of the semiconductor layer ACT, which will be described later. The second gate electrode GE2 may constitute the second gate electrode of the first transistor T1. The second gate electrode GE2 may include a protruding portion protruding in the second direction DR2, and the bias control line Bj described later may be electrically connected to the second gate electrode GE2 through a contact hole CNT.

The semiconductor layer ACT (or a semiconductor pattern) may be an active layer forming channels of the transistors T1 to T7. The semiconductor layer ACT may include a source region and a drain region contacting a first transistor electrode (for example, the source electrode) and a second transistor electrode (for example, the drain electrode) of each of the transistors T1 to T7. A region between the source region and the drain region may be a channel region.

In an embodiment, the semiconductor layer ACT may include a silicon semiconductor (or a poly silicon semiconductor). The channel region of the semiconductor layer may be a semiconductor pattern which may not be doped with impurities and may be an intrinsic semiconductor. The source and drain regions may be semiconductor patterns doped with impurities. P-type impurities may be used as the impurities, but the invention is not limited thereto.

The semiconductor layer ACT may include a first vertical portion (or a first sub-semiconductor pattern), the horizontal portion (or a second sub-semiconductor pattern), a second vertical portion (or a third sub-semiconductor pattern), and a curved portion. The first vertical portion, the horizontal portion, the second vertical portion, and the curved portion may be electrically connected to each other and integrally formed.

The first vertical portion may extend in the first direction DR1 and may be positioned adjacent to one side (for example, the left side) of a pixel region PXA. The first vertical portion may constitute the channel of the second transistor T2 and the channel of the fifth transistor T5. An upper portion of the first vertical portion ACT_S1 may constitute the channel of the second transistor T2, and a lower portion of the first vertical portion ACT_S1 may constitute the channel of the fifth transistor T5.

The horizontal portion may extend in the second direction DR2 from a central portion of the first vertical portion and may have a curved shape. The horizontal portion may constitute the channel of the first transistor T1, and the channel capacitance of the first transistor T1 may be increased by the curved shape.

The second vertical portion may extend in the first direction DR1 and may be positioned adjacent to another side (for example, the right side) of the pixel region PXA. An upper portion of the second vertical portion may constitute the channel of the third transistor T3, and a lower portion of the second vertical portion may constitute the channel of the sixth transistor T6 and the channel of the seventh transistor T7.

The curved portion may extend from an upper end portion of the second vertical portion, have a curved shape, and constitute the channel of the fourth transistor T4.

In an embodiment, the third transistor T3 may include the third_1 and third_2 transistors T3_1 and T3_2 (or first and second sub transistors), and the semiconductor layer ACT may include channel regions of the third_1 and third_2 transistors T3_1 and T3_2, for example, two channel regions electrically connected in series. Similarly, the fourth transistor T4 may include the fourth_1 and fourth_2 transistors T4_1 and T4_2, and the semiconductor layer ACT may include channel regions of the fourth_1 and fourth_2 transistors T4_1 and T4_2, for example two channel regions electrically connected in series.

The second conductive layer GAT1 may include the (i−1)th scan line Si−1, the scan line Si (or the i-th scan line), the (i+1)th scan line Si+1, the emission control line Ei, and the first gate electrode GE1 (or a first capacitor electrode CE1).

The (i−1)th scan line Si−1 may extend in the second direction DR2 and may be positioned on the uppermost side of the pixel region PXA. The (i−1)th scan line Si−1 may overlap the curved portion of the semiconductor layer, and may constitute the gate electrode of the fourth transistor T4 or may be electrically connected to the gate electrode of the fourth transistor T4.

The scan line Si may extend in the second direction DR2 and may be positioned between the (i−1)th scan line Si−1 and the first gate electrode GE1. The scan line Si may overlap the first vertical portion of the semiconductor layer ACT, and may constitute the gate electrode of the second transistor T2 or may be electrically connected to the gate electrode of the second transistor T2. The scan line Si may overlap the second vertical portion of the semiconductor layer ACT, and may constitute the gate electrode of the third transistor T3 or may be electrically connected to the gate electrode of the third transistor T3.

The first gate electrode GE1 may have a predetermined area and may be generally positioned at the central portion of the pixel region PXA. The first gate electrode GE1 may overlap the horizontal portion (and the second gate electrode GE2) of the semiconductor layer ACT. The first gate electrode GE1 may constitute the first gate electrode of the first transistor T1.

The emission control line Ei may extend in the second direction DR2 and may be positioned below the first gate electrode GE1. The emission control line Ei may overlap the first and second vertical portions of the semiconductor layer ACT, respectively. The emission control line Ei may constitute the gate electrode of the fifth transistor T5 and the gate electrode of the sixth transistor T6, respectively, or may be electrically connected to the gate electrode of the fifth transistor T5 and the gate electrode of the sixth transistor T6.

The (i+1)th scan line Si+1 may extend in the second direction DR2 and may be positioned at the lowermost side of the pixel region PXA. The (i+1)th scan line Si+1 may overlap the second vertical portion of the semiconductor layer ACT, and may constitute the gate electrode of the seventh transistor T7 or may be electrically connected to the gate electrode of the seventh transistor T7.

The second conductive layer GAT1 may include at least one metal selected from the group consisting of molybdenum (Mo), aluminum (Al), platinum (Pt), palladium (Pd), silver (Ag), magnesium (Mg), gold (Au), nickel (Ni), neodymium (Nd), iridium (Ir), chromium (Cr), titanium (Ti), tantalum (Ta), tungsten (W), and copper (Cu). The second conductive layer GAT1 may have a single layer structure or a multilayer structure. For example, the second conductive layer GAT1 may have the single layer structure including molybdenum (Mo).

The third conductive layer GAT2 may include a third power source line PL3 and a second capacitor electrode CE2.

The third power source line PL3 may extend in the second direction DR2 and may be disposed adjacent to an upper side (or a lower side) of the pixel region PXA. The third power source line PL3 may be electrically connected to the initialization power source Vint described with reference to FIG. 2. The third power source line PL3 may overlap the curved portion of the semiconductor layer ACT and may be electrically connected to one end portion of the curved portion of the semiconductor layer ACT through a contact hole CNT exposing the curved portion of the semiconductor layer ACT. The third power source line PL3 may constitute a second electrode of the fourth transistor T4 and a second electrode of the seventh transistor T7 or may be electrically connected to the second electrode of the fourth transistor T4 and the second electrode of the seventh transistor T7.

The second capacitor electrode CE2 may overlap the first gate electrode GE1 (or the first capacitor electrode CE1), and may constitute the storage capacitor Cst described with reference to FIG. 2 together with the first gate electrode GE1. The area of the second capacitor electrode CE2 may be greater than that of the first gate electrode GE1 and may cover the first gate electrode GE1. The second capacitor electrode CE2 may include an opening exposing the first gate electrode GE1 at a central portion thereof.

The third conductive layer GAT2 may include at least one metal selected from the group consisting of molybdenum (Mo), aluminum (Al), platinum (Pt), palladium (Pd), silver (Ag), magnesium (Mg), gold (Au), nickel (Ni), neodymium (Nd), iridium (Ir), chromium (Cr), titanium (Ti), tantalum (Ta), tungsten (W), and copper (Cu). The third conductive layer GAT2 may have a single layer structure or a multilayer structure. For example, the third conductive layer GATs may have the single layer structure including molybdenum (Mo).

The fourth conductive layer SD may include the bias control line Bj, the data line Dj, a first power source line PL1, a first conductive pattern BRP1 (or a first bridge pattern), and a second conductive pattern BRP2 (or a second bridge pattern).

The bias control line Bj may extend in the first direction DR1 and may be disposed adjacent to one side of the pixel region PXA. The bias control line Bj may overlap the protruding portion of the second gate electrode GE2. The bias control line Bj may be electrically connected to the second gate electrode GE2 through a contact hole CNT exposing the protruding portion of the second gate electrode GE2.

The data line Dj may extend in the first direction DR1 and may overlap an upper end portion of the first vertical portion of the semiconductor layer ACT. The data line Dj may be electrically connected to the upper end portion of the first vertical portion of the semiconductor layer ACT through a contact hole CNT exposing the upper end portion of the first vertical portion of the semiconductor layer ACT. The data line Dj may constitute a first electrode of the second transistor T2 or may be electrically connected to the first electrode of the second transistor T2.

The first power source line PL1 may extend in the first direction DR1 and may overlap the second capacitor electrode CE2 and a lower end portion of the first vertical portion of the semiconductor layer ACT. The first power source line PL1 may be electrically connected to the first power source ELVDD described with reference to FIG. 2. The first power source line PL1 may be electrically connected to the second capacitor electrode CE2 through a contact hole CNT exposing the second capacitor electrode CE2. The first power source line PL1 may be electrically connected to the lower end portion of the first vertical portion of the semiconductor layer ACT through a contact hole CNT exposing the lower end portion of the first vertical portion of the semiconductor layer ACT. The first power source line PL1 may constitute a first electrode of the fifth transistor T5 or may be electrically connected to the first electrode of the fifth transistor T5.

The first conductive pattern BRP1 may overlap one end portion of the curved portion of the semiconductor layer ACT and the first gate electrode GE1. The first conductive pattern BRP1 may be electrically connected to the one end portion of the curved portion of the semiconductor layer ACT through a contact hole exposing the one end portion of the curved portion of the semiconductor layer ACT. The first conductive pattern BRP1 may be electrically connected to a first electrode of the third transistor T3 (or the third_1 transistor T3_1) and a first electrode of the fourth transistor T4 (or the fourth_1 transistor T4_1), respectively, or may constitute the first electrode of the third transistor T3 and the first electrode of the fourth transistor T4.

The first conductive pattern BRP1 may be electrically connected to the first gate electrode GE1 through a contact hole CNT exposing the first gate electrode GE1 (and the opening of the second gate electrode GE2).

The second conductive pattern BRP2 may overlap one end portion of the second vertical portion of the semiconductor layer ACT and electrically connected to the one end portion of the second vertical portion of the semiconductor layer ACT through a contact hole CNT exposing the one end portion of the second vertical portion of the semiconductor layer ACT. The second conductive pattern BRP2 may constitute a second electrode of the sixth transistor T6 and a first electrode of the seventh transistor T7, respectively, or may be electrically connected to the second electrode of the sixth transistor T6 and the first electrode of the seventh transistor T7. The second conductive pattern BRP2 may be electrically connected to the light emitting element EL (or the anode electrode of the light emitting element EL) described with reference to FIG. 3 through a via hole VIA exposing the second conductive pattern BRP2.

The fourth conductive layer SD may include at least one metal selected from the group consisting of molybdenum (Mo), aluminum (Al), platinum (Pt), palladium (Pd), silver (Ag), magnesium (Mg), gold (Au), nickel (Ni), neodymium (Nd), iridium (Ir), chromium (Cr), titanium (Ti), tantalum (Ta), tungsten (W), and copper (Cu). The fourth conductive layer SD may have a single layer structure or a multilayer structure. For example, the fourth conductive layer SD may have the multilayer structure of Ti/Al/Ti.

Figure 4:
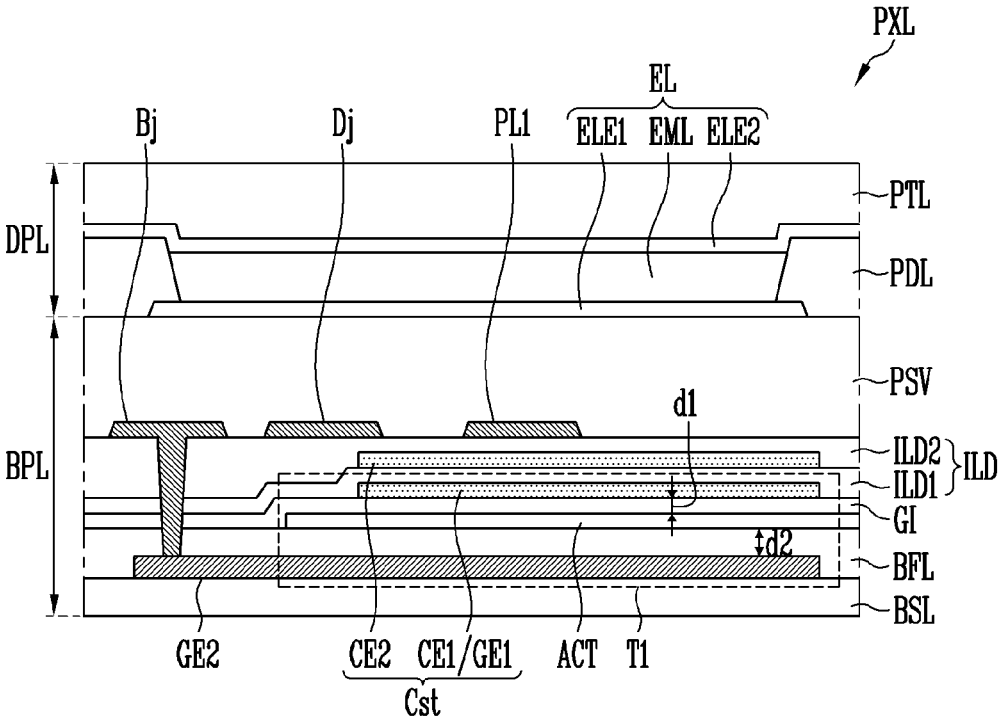
FIG. 4 is a schematic cross-sectional view illustrating an example of the pixel taken along line I-I' of FIG. 3.

FIG. 4 is a schematic cross-sectional view illustrating an example of the pixel taken along line I-I' of FIG. 3.

Referring to FIGS. 3 and 4, the pixel PXL may include a pixel circuit layer BPL (or a backplane layer) on which a pixel circuit and wirings connected thereto may be disposed, and a display element layer DPL disposed on the pixel circuit layer BPL and including the light emitting element EL.

The pixel circuit layer BPL may include at least one circuit element electrically connected to the light emitting element EL. For example, the pixel circuit layer BPL may include transistors and a storage capacitor Cst which may be disposed in each pixel region and constitute the pixel circuit PXC of each pixel PXL. The pixel circuit layer BPL may further include signal lines and power source lines electrically connected to each pixel circuit PXC and/or each light emitting element EL. For example, as illustrated in FIG. 4, the pixel circuit layer BPL may include the second gate electrode GE2, the first gate electrode GE1 (or the first capacitor electrode CE1), the second capacitor electrode CE2, the bias control line Bj, the data line Dj, and the first power source line PL1 described with reference to FIG. 3.

The pixel circuit layer BPL may include a base layer BSL as a substrate of a display panel, and insulating layers disposed on the base layer BSL. For example, the pixel circuit layer BPL may include a buffer layer BFL, a gate insulating layer GI, an interlayer insulating layer ILD, and/or a passivation layer PSV sequentially stacked on each other on a surface of the base layer BSL.

The base layer BSL may be a rigid or flexible substrate or film. The material and physical properties of the base layer BSL are not particularly limited. For example, the base layer BSL may be a rigid substrate made of glass or tempered glass, a flexible substrate (or a thin film) made of plastic or metal, or at least one insulating layer. The material and/or physical properties of the base layer BSL are not particularly limited.

The base layer BSL may be transparent, but the invention is not limited thereto. For example, the base layer BSL may be a transparent, translucent, opaque, or reflective base member.

One region on the base layer BSL may be defined as the display region 10 to arrange the pixel PXL, and the remaining region may be defined as a non-display region. For example, the base layer BSL may include the display region 10 including pixel regions in which the pixels PXL may be formed, and the non-display region positioned outside the display region 10. Various wirings and/or internal circuits (for example, a gate driving circuit including the scan driver 21, the emission control driver 22, and/or the control line driver 23) electrically connected to the pixels PXL of the display region 10 may be disposed in the non-display region.

The buffer layer BFL may prevent impurities from diffusing into each circuit element. The buffer layer BFL may be composed of a single layer, but may be composed of at least two or more multilayers. When the buffer layer BFL is provided in multiple layers, each layer may be formed of the same material or different materials.

The first transistor T1 may include the semiconductor layer ACT (or an active pattern), the first gate electrode GE1, and the second gate electrode GE2.

The semiconductor layer ACT may be disposed on the buffer layer BFL. For example, the semiconductor layer ACT may be disposed on one surface of the base layer BSL on which the buffer layer BFL may be formed. The semiconductor layer ACT may include the source region electrically connected to the source electrode, the drain region electrically connected to the drain electrode, and the channel region positioned between the source and drain regions.

The first gate electrode GE1 and the second gate electrode GE2 may overlap the semiconductor layer ACT of the first transistor T1, particularly the channel region, and may be disposed on different layers with the channel region interposed therebetween. For example, the first gate electrode GE1 may be positioned above the semiconductor layer ACT, and the second gate electrode GE2 may be positioned below the semiconductor layer ACT. For example, the first gate electrode GE1 may be disposed on the gate insulating layer GI so as to overlap the semiconductor layer ACT, and the second gate electrode GE2 may be disposed between the base layer BSL and the buffer layer BFL so as to overlap the semiconductor layer ACT.

The gate insulating layer GI may be disposed on the semiconductor layer ACT. For example, the gate insulating layer GI may be interposed between the semiconductor layer ACT and the first gate electrode GE1. The gate insulating layer GI may be composed of a single layer or multiple layers, and may include at least one inorganic insulating material and/or at least one organic insulating material. For example, the gate insulating layer GI may include various known organic/inorganic insulating materials such as silicon nitride (SiNx) and/or silicon oxide (SiOx), and the like. The material of the gate insulating layer GI is not particularly limited.

According to an embodiment, the thickness of the gate insulating layer GI may be smaller than that of the buffer layer BFL. Accordingly, a distance d1 between the first gate electrode GE1 of the first transistor T1 and the semiconductor layer ACT may be smaller than a distance d2 between the second gate electrode GE2 of the first transistor T1 and the semiconductor layer ACT. The magnitude of the driving current Ids generated by the first transistor T1 may be determined by the first gate voltage applied to the first gate electrode GE1. The threshold voltage of the first transistor T1 may vary depending on the voltage of the control signal applied to the second gate electrode GE2. The voltage of the control signal may be a back-bias voltage.

The interlayer insulating layer ILD may be disposed on the first gate electrode GE1. For example, the interlayer insulating layer ILD may be disposed on the first gate electrode GE1. For example, the interlayer insulating layer ILD may be interposed between the first gate electrode GE1 and the first power source line PL1. The interlayer insulating layer ILD may be composed of a single layer or multiple layers. For example, the interlayer insulating layer ILD may be composed of the multiple layers including a first interlayer insulating layer ILD1 and a second interlayer insulating layer ILD2.

The interlayer insulating layer ILD may include at least one inorganic insulating material and/or at least one organic insulating material. For example, the interlayer insulating layer ILD may include various known organic/inorganic insulating materials, and the material of the interlayer insulating layer ILD is not particularly limited.

The storage capacitor Cst may include the first capacitor electrode CE1 and the second capacitor electrode CE2 disposed on the same layer as any one electrode of the first transistor T1 or disposed on different layers from each other. For example, the first capacitor electrode CE1 of the storage capacitor Cst may be disposed on the gate insulating layer GI together with the first gate electrode GE1, and the second capacitor electrode CE2 of the storage capacitor Cst may be disposed between the first interlayer insulating layer ILD1 and the second interlayer insulating layer ILD2.

The bias control line Bj, the data line Dj, and the first power source line PL1 (that is, the fourth conductive layer SD described with reference to FIG. 3) may be disposed on each semiconductor layer ACT with the first interlayer insulating layer ILD1 and/or the second interlayer insulating layer ILD2 interposed therebetween. The bias control line Bj may be electrically connected to the second gate electrode GE2 through a contact hole penetrating through the buffer layer BFL, the gate insulating layer GI, the first interlayer insulating layer ILD1, and the second interlayer insulating layer ILD2.

Structures and positions of various circuit elements, wirings, and insulating layers formed in the pixel circuit layer BPL may be variously changed according to embodiments. The passivation layer PSV may be disposed on the circuit elements and the wirings.

The passivation layer PSV may be composed of a single layer or multiple layers. When the passivation layer PSV is provided in the multiple layers, each layer may be formed of the same material or different materials. For example, the passivation layer PSV may be composed of the multiple layers including a first passivation layer formed of at least one inorganic insulating layer and a second passivation layer formed of at least one organic insulating layer. When the passivation layer PSV includes the organic insulating layer, the surface of the pixel circuit layer BPL may be substantially flat.

The display element layer DPL may include the light emitting element EL. The display element layer DPL may further include a bank structure for defining a light emitting region (for example, a light emitting region of each pixel PXL) in which each light emitting element EL is disposed, for example, a pixel defining layer PDL, and a protective layer PTL for protecting the light emitting element EL.

The light emitting element EL may include a first electrode ELE1, a light emitting layer EML, and a second electrode ELE2 sequentially stacked on each other on the passivation layer PSV. According to an embodiment, one of the first and second electrodes ELE1 and ELE2 of the light emitting element EL may be the anode electrode, and another may be the cathode electrode. For example, when the first electrode ELE1 is the anode electrode, the second electrode ELE2 may be the cathode electrode.

The first electrode ELE1 of the light emitting element EL may be disposed on the passivation layer PSV, and may be electrically connected to at least one circuit element constituting each pixel circuit PXC through a contact hole (not shown). For example, the first electrode ELE1 may be electrically connected to one electrode of the sixth and seventh transistors T6 and T7 through a contact hole or a via hole VIA (refer to FIG. 3) passing through the passivation layer PSV.

The pixel defining layer PDL may be formed in each pixel region in which the first electrode ELE1 may be formed to partition the light emitting region of each pixel PXL. The pixel defining layer PDL may be disposed between the light emitting regions of the pixels PXL and may have an opening that exposes the first electrode ELE1 in the light emitting region of each pixel PXL. For example, the pixel defining layer PDL may protrude upward from one surface of the base layer BSL on which the first electrode ELE1 and the like may be formed along the outer circumference of the light emitting region of each pixel PXL.

The light emitting layer EML may be formed in each light emitting region surrounded by the pixel defining layer PDL. For example, the light emitting layer EML may be disposed on an exposed surface of the first electrode ELE1. According to an embodiment, the light emitting layer EML may have a multilayer thin film structure including at least a light generation layer. For example, the light emitting layer EML may include the light generation layer emitting light of a predetermined color, a first common layer disposed between the light generation layer and the first electrode ELE1, and a second common layer disposed between the light generation layer and the second electrode ELE2. According to an embodiment, the first common layer may include at least one of a hole injection layer and a hole transport layer. According to an embodiment, the second common layer may include at least one of a hole blocking layer, an electron transport layer, and an electron injection layer. In an embodiment, the light generation layer may be individually patterned to correspond to each light emitting region. The first common layer and the second common layer may be formed on the entire surface of the display region 10 (refer to FIG. 1) in which the pixels PXL may be disposed.

The second electrode ELE2 of the light emitting element EL may be formed on the light emitting layer EML. According to an embodiment, the second electrode ELE2 may be formed on the entire surface of the display region 10 (refer to FIG. 1), but the invention is not limited thereto.

The protective layer PTL may be formed on the light emitting element EL to cover the second electrode ELE2 of the light emitting element EL. According to an embodiment, the protective layer PTL may be disposed on one region (for example, at least the display region 10 of FIG. 1) of the display panel on which the pixels PXL may be disposed, and may include an encapsulation layer or an encapsulating substrate to seal the pixels PXL. For example, the protective layer PTL may include a thin film encapsulation layer. When the thin film encapsulation layer is formed to seal the display region 10 (refer to FIG. 1), the thickness of the display panel may be reduced and flexibility may be secured while protecting the pixels PXL.

According to an embodiment, the protective layer PTL may be composed of a single layer or multiple layers. For example, the protective layer PTL may be composed of the multiple layers including at least two inorganic layers overlapping each other and at least one organic layer interposed between the inorganic layers. However, the structure and material of the protective layer PTL may be variously changed according to embodiments.

According to an embodiment of the invention, the structures of the pixel PXL and the display panel including the pixel PXL are not limited to the embodiment illustrated in FIG. 4, and may be variously changed according to embodiments. For example, the pixel PXL and the display panel including the pixel PXL may be formed in various known structures.

Figure 5A:
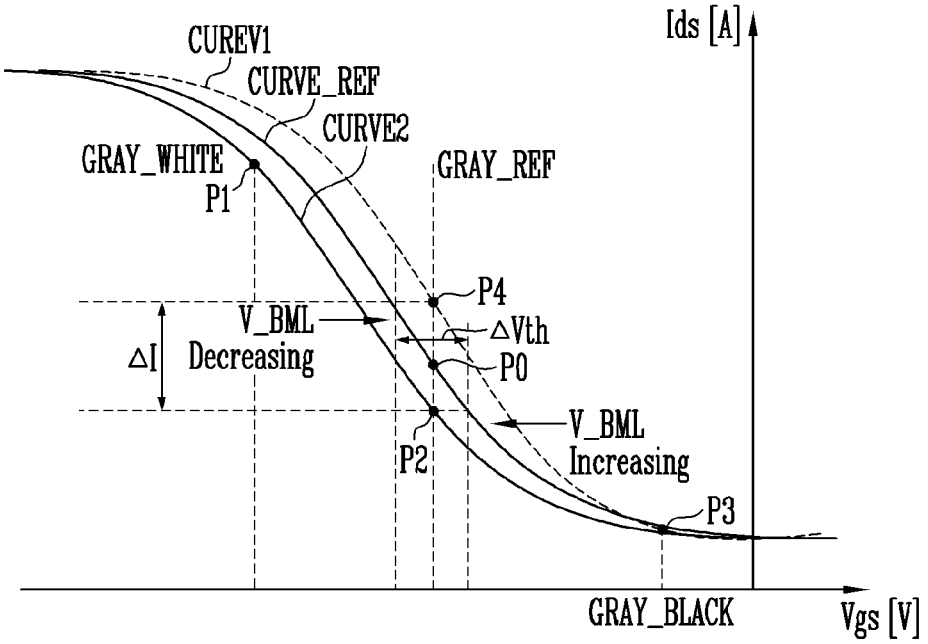
FIG. 5A is a schematic graph illustrating current-voltage characteristics of a first transistor included in the pixel of FIG. 2.

FIG. 5A is a schematic graph illustrating current-voltage characteristics of a first transistor included in the pixel of FIG. 2.

Referring to FIGS. 2 and 5A, a first curve CURVE1 represents current-voltage characteristic of the first transistor T1 when a voltage (for example, Vgs) corresponding to a maximum grayscale (for example, white grayscale GRAY_WHITE) may be continuously applied to the first gate electrode GE1 of the first transistor T1 (or when the pixel PXL emits light continuously). A second curve CURVE2 represents current-voltage characteristic of the first transistor T1 when a voltage corresponding to a minimum grayscale (for example, black grayscale GRAY_BLACK) may be applied to the first gate electrode GE1 of the first transistor T1 (or when the pixel PXL does not emit light continuously).

After the pixel PXL emits light for a predetermined time in response to a grayscale smaller than 48 grayscales which may be a low grayscale (for example, a reference grayscale GRAY_REF), or the black grayscale of 0, or after the pixel PXL does not emit light, the pixel PXL may emit light in response to the reference grayscale GRAY_REF (or a high grayscale greater than the reference grayscale GREF_REF). The driving current Ids flowing through the first transistor T1 of the pixel PXL may be changed from a value corresponding to a third point P3 positioned on the first curve CURVE1 to a value corresponding to a fourth point P4. After a predetermined time has elapsed, the driving current Ids may be changed to a value corresponding to a second point P2 positioned on the second curve CURVE2 (or a reference point P0 positioned on a reference curve CURVE_REF). For example, when the grayscale value of the pixel PXL is changed to the high grayscale after being maintained at the low grayscale for a predetermined time, the driving current Ids of the first transistor T1 may be instantaneously increased from a low grayscale current to more than a high grayscale current, and may be changed to a target current after a predetermined time.

On the other hand, after the pixel PXL emits light for a predetermined time in response to the high grayscale (for example, a grayscale greater than 48 grayscales or the white grayscale GRAY_WHITE of 255), the pixel PXL may emit light in response to the reference grayscale GRAY_REF (or a low grayscale smaller than the reference grayscale GRAY_REF). The driving current Ids flowing through the first transistor T1 of the pixel PXL may be changed from a value corresponding to a first point P1 positioned on the second curve CURVE2 to a value corresponding to the second point P2. After a predetermined time has elapsed, the driving current Ids may be changed to a value corresponding to the fourth point P4 positioned on the first curve CURVE1 (or the reference point P0 positioned on the reference curve CURVE_REF). For example, when the grayscale value of the pixel PXL is changed to the low grayscale after being maintained at the high grayscale for a predetermined time, the driving current Ids of the first transistor T1 may be instantaneously decreased from the high grayscale current to less than the low grayscale current, and may be changed to the target current after a predetermined time.

That is, according to the hysteresis characteristic of the first transistor T1, a change ΔVth of the threshold voltage of the first transistor T1 may occur, and a luminance difference between adjacent pixels may occur. For example, since the luminance of the pixel including the first transistor T1 having the current-voltage characteristic according to the first curve CURVE1 and the luminance of the pixel including the first transistor T1 having the current-voltage characteristic according to the second curve CURVE2 may be different from each other, a momentary afterimage may occur and image quality may deteriorate. The momentary afterimage will be described later with reference to FIGS. 6A and 6B.

Accordingly, the display device 1 (refer to FIG. 1) according to the embodiment of the invention may calculate the stress of the first transistor T1, and vary the voltage of the control signal provided to the second gate electrode GE2 of the first transistor T1 based on the stress. Therefore, the current-voltage characteristic of the pixel PXL may coincide with the reference curve CURVE_REF.

For example, when the pixel PXL emits light for a predetermined time in response to the high grayscale (that is, after high grayscale stress may be applied to the pixel PXL) and then emits light in response to a middle grayscale (for example, the reference grayscale GRAY_REF of 48), the display device 1 (refer to FIG. 1) may reduce the voltage of the control signal V_BML, to a low level. The threshold voltage of the first transistor T1 may be shifted in the positive direction, and the current-voltage characteristic of the first transistor T1 may be changed from the second curve CURVE2 to the reference curve CURVE_REF.

As another example, when the pixel PXL emits light for a predetermined time in response to the low grayscale or does not emit light (that is, after low grayscale stress may be applied to the pixel PXL) and then emits light in response to the middle grayscale (for example, the reference grayscale GRAY_REF of 48), the display device 1 (refer to FIG. 1) may increase the voltage of the control signal V_BML to a high level. The threshold voltage of the first transistor T1 may be shifted in the negative direction, and the current-voltage characteristic of the first transistor T1 may be changed from the first curve CURVE1 to the reference curve CURVE_REF.

Therefore, since the luminance of the pixels may be the same (for example, since the change in the threshold voltage ΔVth and/or the current difference ΔI may be reduced or eliminated), the momentary afterimage may be alleviated or eliminated, and the image quality may be improved.

Figure 5B:
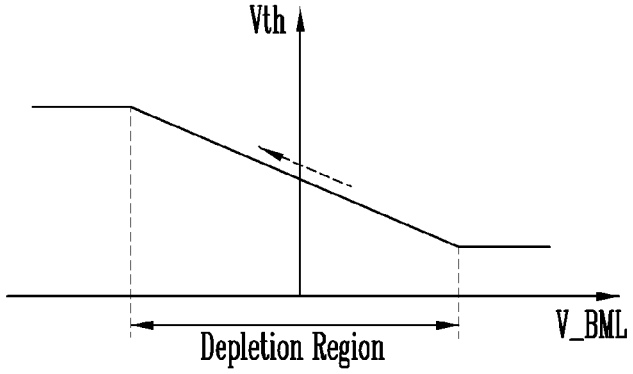
FIG. 5B is a schematic graph illustrating a threshold voltage of the first transistor according to a control signal applied to the first transistor included in the pixel of FIG. 2.

FIG. 5B is a schematic graph illustrating a threshold voltage of the first transistor according to a control signal applied to the first transistor included in the pixel of FIG. 2.

Referring to FIGS. 2 and 5B, according to the control signal V_BML (or the second gate voltage) applied to the second gate electrode GE2 of the first transistor T1, the threshold voltage Vth of the first transistor T1 may be changed. The threshold voltage Vth of the first transistor T1 may represent a threshold voltage with respect to the first gate voltage applied to the first gate electrode GE1 of the first transistor T1.

When the voltage of the control signal V_BML applied to the second gate electrode GE2 of the first transistor T1 is changed in a depletion region range, the threshold voltage Vth of the first transistor T1 may be changed. For example, when the first transistor T1 is the P-type transistor, as the control signal V_BML decreases, the threshold voltage Vth of the first transistor T1 may increase.

Therefore, by adjusting the voltage of the control signal supplied to the bias control line Bj, the threshold voltage Vth of the first transistor T1 may be adjusted. As described with reference to FIG. 5A, when the high grayscale stress is applied to the first transistor T1, the threshold of the first transistor T1 may be increased by decreasing the voltage of the control signal V_BML supplied to the bias control line Bj. When the low grayscale stress is applied to the first transistor T1, the threshold of the first transistor T1 may be decreased by increasing the voltage of the control signal V_BML supplied to the bias control line Bj. Accordingly, even when various stresses are applied to the first transistor T1, the driving current Ids may flow uniformly through the light emitting element EL by the first transistor T1.

Figure 6A:
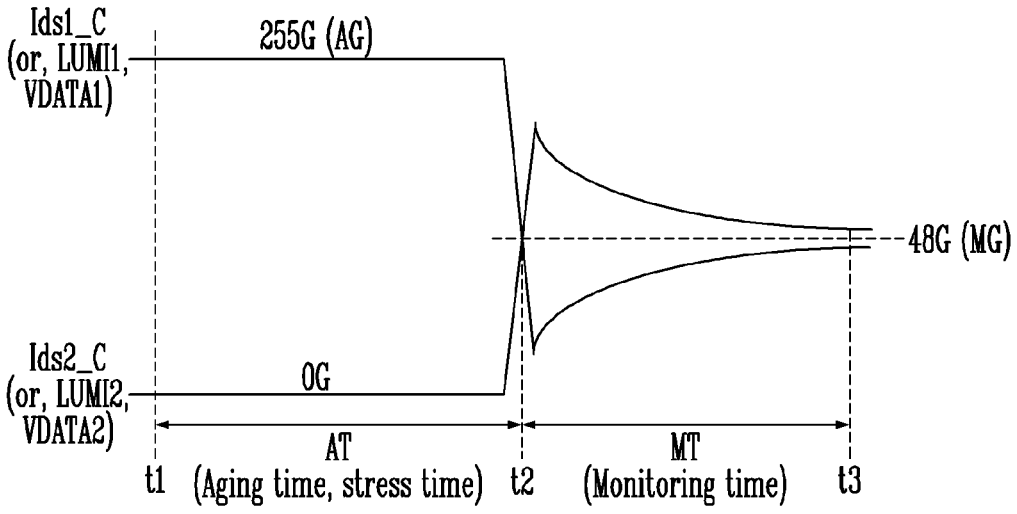
FIG. 6A is a schematic waveform diagram illustrating a comparative example of signals measured in the pixel of FIG. 2.
Figure 6B:
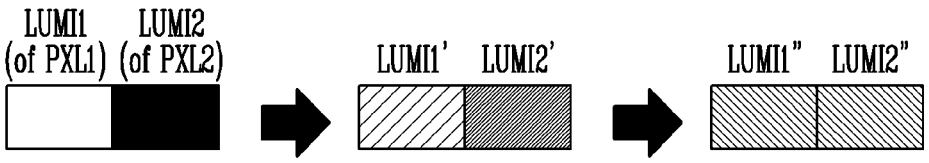
FIG. 6B is a schematic diagram illustrating a change in luminance according to the waveform diagram of FIG. 6A.

FIG. 6A is a schematic waveform diagram illustrating a comparative example of signals measured in the pixel of FIG. 2. FIG. 6B is a schematic diagram illustrating a change in luminance according to the waveform diagram of FIG. 6A. For example, a first driving current Ids1_C and a first luminance LUMI1 illustrated in FIG. 6A may represent the driving current and the luminance measured in the first pixel PXL1 illustrated in FIG. 1. A second driving current Ids2_C and a second luminance LUMI2 illustrated in FIG. 6A may represent the driving current and the luminance measured in the second pixel PXL2 illustrated in FIG. 1.

Referring to FIGS. 1, 2 and 6A, an afterimage causing pattern may be applied to the display device 1 (refer to FIG. 1) for a predetermined time. For example, during an aging time AT between a first time point t1 and a second time point t2 (or during a stress time, for example, for 10 seconds), a first data voltage VDATA1 corresponding to the maximum grayscale of 255 may be applied to the first pixel PXL1, and a second data voltage VDATA2 corresponding to the minimum grayscale of 0 may be applied to the second pixel PXL2.

Subsequently, at the second time point t2, a data voltage corresponding to the middle grayscale (for example, 48 grayscales) may be applied to the first pixel PXL1 and the second pixel PXL2.

As described with reference to FIG. 5A, the luminance difference between the first driving current Ids1_C (or the first luminance LUMI1) of the first pixel PXL1 and the second driving current Ids2_C (or the second luminance LUMI2) of the second pixel PXL2 may be largely generated, and the luminance difference may be gradually reduced from the second time point t2 to a third time point t3.

The time (for example, monitoring time MT) until the transient contrast ratio (TCR) becomes smaller than a reference ratio (for example, about 0.4%) may be defined as a momentary afterimage index indicating the size of the momentary afterimage. Here, on the basis of the sum of the first luminance LUMI1' (refer to FIG. 6B) after the second time point t2 of the first pixel PXL1 to which the high grayscale stress may be applied and the second luminance LUMI2' (refer to FIG. 6B) after the second time point t2 of the second pixel PXL2 to which the low grayscale stress may be applied, the transient contrast ratio may be defined as a ratio of the difference between the first luminance LUMI1' and the second luminance LUMI2'. When the transient contrast ratio is smaller than the reference ratio, as illustrated in FIG. 6B, the luminance difference between a first luminance LUMI1" and a second luminance LUMI2" at the third time point t3 may not be visually recognized by a user.

When a separate control signal is not applied to the second gate electrode GE2 of the first transistor T1, the monitoring time MT (or the momentary afterimage index) may be greater than 10 seconds.

Figure 6C:
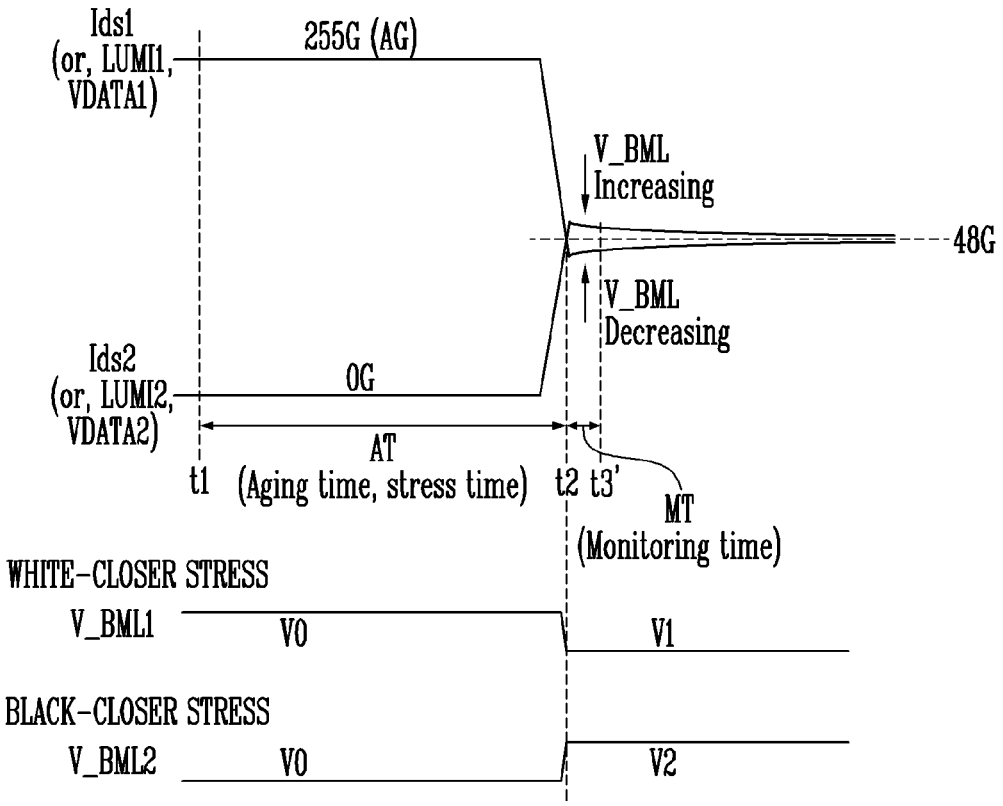
FIG. 6C is a schematic waveform diagram illustrating an example of signals measured in the pixel of FIG. 2.

FIG. 6C is a schematic waveform diagram illustrating an example of signals measured in the pixel of FIG. 2.

Referring to FIGS. 1, 2, 6A and 6C, at the second time point t2, a first control signal V_BML1 applied to the first transistor T1 of the first pixel PXL1 to which the high grayscale stress WHITE-CLOSER STRESS may be applied may be changed to a first voltage V1 lower than a reference voltage V0. As described with reference to FIG. 5A, the threshold voltage of the first transistor T1 of the first pixel PXL1 may be shifted in the positive direction, and the variation range of the first driving current Ids1 may be reduced at the second time point t2.

At the second time point t2, a second control signal V_BML2 applied to the first transistor T1 of the second pixel PXL2 to which the low grayscale stress BLACK-CLOSER STRESS may be applied may be changed to a second voltage V2 higher than the reference voltage V0. As described with reference to FIG. 5A, the threshold voltage of the first transistor T1 of the second pixel PXL2 may be shifted in the negative direction, and the variation range of the second driving current Ids2 may be reduced at the second time point t2.

Therefore, at a third time point t3', the transient contrast ratio (TCR) may be smaller than the reference ratio, and the monitoring time MT (or the momentary afterimage index) may be significantly reduced. For example, when the control signal is variably applied to the second gate electrode GE2 of the first transistor T1, the monitoring time MT (or the momentary afterimage index) may be about 5 seconds or less and about 1 second or less.

Figure 7:
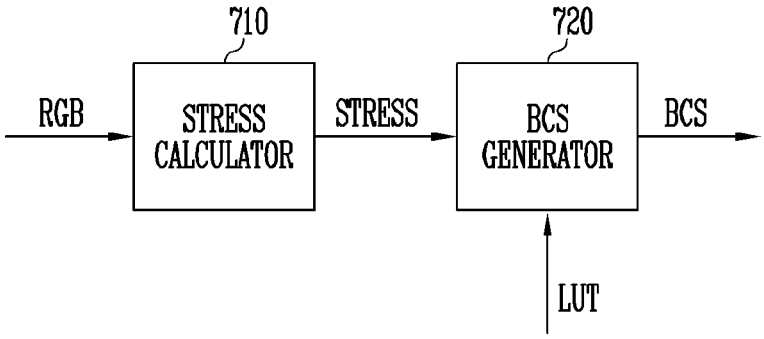
FIG. 7 is a schematic block diagram illustrating an example of a timing controller included in the display device of FIG. 1.
Figure 8:
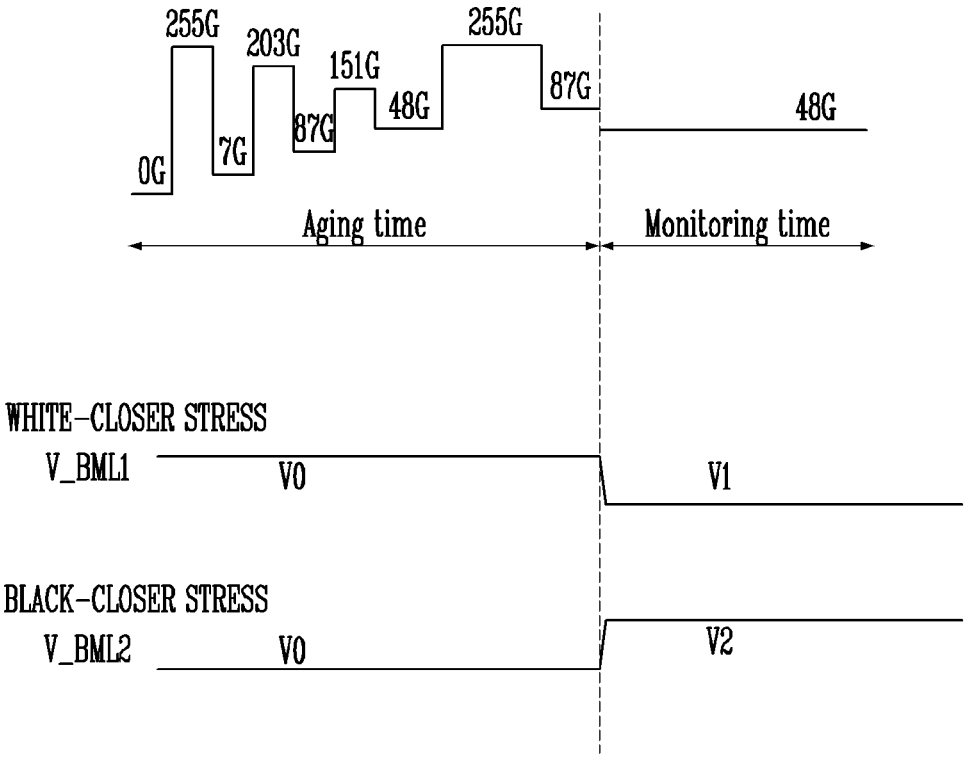
FIG. 8 is a schematic waveform diagram illustrating another example of signals measured in the pixel of FIG. 2.

FIG. 7 is a schematic block diagram illustrating an example of a timing controller included in the display device of FIG. 1. FIG. 8 is a schematic waveform diagram illustrating another example of signals measured in the pixel of FIG. 2.

Referring to FIGS. 1 and 7, the timing controller 25 (or the driving circuits 21 to 25) may include a stress calculator 710 (or a stress calculation circuit) and a bias drive control signal generator 720 (or a bias drive control signal generation circuit).

The stress calculator 710 may calculate the stress of the pixel PXL (or the first transistor T1 (refer to FIG. 2) included in the pixel PXL) by accumulating the first grayscale value (that is, the grayscale value corresponding to the pixel PXL) included in the image data RGB for a predetermined time. Here, the predetermined time may correspond to the aging time AT described with reference to FIG. 6A. The predetermined time may be fixed or variable. For example, the predetermined time may be about 10 seconds. The stress calculator 710 may initialize and recalculate the stress of the pixel PXL every 10 seconds. As another example, the predetermined time may be determined by the time points at which the change amount of the first grayscale value exceeds a reference value. The stress calculator 710 may determine the time from a time point (for example, the first time point t1 of FIG. 6A) when the change amount of the first grayscale value is smaller than the reference value to a time point (for example, the second time point t2 of FIG. 6A) when the first grayscale value is rapidly changed, as the predetermined time, and may calculate the stress of the pixel PXL by accumulating the first grayscale value for the predetermined time. The stress may correspond to an average grayscale value for the predetermined time.

Referring to FIG. 8, for example, the first grayscale value may vary during the aging time AT. For example, the first grayscale value may sequentially have grayscale values of 0, 255, 7, 203, 87, 151, 48, 255, and 87, and each light emitting time may be different from each other. The stress calculator 710 may calculate the stress of the pixel PXL by integrating the first grayscale value over time.

According to an embodiment, the stress calculator 710 may calculate the stress (that is, average stress) of the pixels by integrating the grayscale values of the pixels of the vertical line. As described with reference to FIG. 1, each of the bias control lines B1 to Bm may be electrically connected to the pixels arranged along the vertical line, and the control signal may be commonly provided to the pixels. Accordingly, the stress calculator 710 may calculate stresses of the pixels electrically connected to the data line by accumulating all grayscale values corresponding to the data signal applied to one data line.

The stress calculator 710 may determine the type of stress based on the stress. For example, the stress calculator 710 may compare the stress with the reference stress, and when the stress is greater than the reference stress, the stress calculator 710 may determine that the type of stress (that is, the stress type) is the high grayscale stress WHITE-CLOSER STRESS. As another example, when the stress is smaller than the reference stress, the stress calculator 710 may determine that the type of stress is the low grayscale stress BLACK-CLOSER STRESS.

In an embodiment, the stress calculator 710 may determine the type of stress based on the stress and the second grayscale value (that is, the second grayscale value corresponding to the pixel PXL) at the present time point.

Referring to FIG. 8, for example, when the stress is greater than the second grayscale value (or a value calculated by multiplying the second grayscale value and the aging time AT) at the present time point, the stress calculator 710 may determine that the type of stress is the high grayscale stress WHITE-CLOSER STRESS. As another example, when the stress is smaller than the second grayscale value (or the value calculated by multiplying the second grayscale value and the aging time AT) at the present time point, the stress calculator 710 may determine that the type of stress is the low grayscale stress BLACK-CLOSER STRESS.

The bias drive control signal generator 720 may generate the bias drive control signal based on the stress (and the stress type).

For example, when the stress type is the high grayscale stress WHITE-CLOSER STRESS, the bias drive control signal generator 720 may generate the bias drive control signal to reduce the voltage of the control signal (for example, the first control signal V_BML1 of the first pixel PXL1). For example, the first control signal V_BML1 may be changed to the first voltage V1 lower than the reference voltage V0. As another embodiment, when the stress type is the low grayscale stress BLACK-CLOSER STRESS, the bias drive control signal generator 720 may generate the bias drive control signal to increase the voltage of the control signal (for example, the second control signal V_BML2 of the second pixel PXL2). For example, the second control signal V_BML2 may be changed to the second voltage V2 higher than the reference voltage V0.

In an embodiment, the bias drive control signal generator 720 may generate the bias drive control signal based on the stress (and the stress type) and the second grayscale value at the present time point.

For example, the bias drive control signal generator 720 may determine the voltage of the control signal based on the second grayscale value at the present time point by using a lookup table LUT.

FIG. 9 is a schematic diagram illustrating an example of a lookup table used in the timing controller of FIG. 7.

Referring to FIGS. 7 and 9, when the high grayscale stress is applied to the pixel PXL, the lookup table LUT may include or store the voltage (or voltage information) of the control signal according to the second grayscale value of the pixel PXL at the present time point and the monitoring time (that is, the momentary afterimage index, refer to FIG. 6A). The lookup table LUT may be stored in the driving circuits 21 to 25 (or the timing controller 25).

Hereinafter, an example in which the high grayscale stress may be applied to the pixel PXL will be described. For example, the pixel PXL emits light at the maximum grayscale for about 10 seconds. The monitoring time may be set to about 4 seconds, and the reference voltage of the control signal may be set to about 7V.

For example, when the second grayscale value of the pixel PXL at the present time point is 203 grayscales or 255 grayscales, the bias drive control signal generator 720 may maintain the voltage of the control signal at about 7V. Although the high grayscale stress may be applied to the pixel PXL, since no momentary afterimage occurs, the voltage of the control signal may be maintained at about 7V.

As another example, when the second grayscale value of the pixel PXL at the present time point is 48 grayscales, 87 grayscales, 128 grayscales, or 151 grayscales, the bias drive control signal generator 720 may change the voltage of the control signal to about 6.75V which is about −0.25V lower than about 7V. For example, since the momentary afterimage may occur as the second grayscale value changes from the high grayscale to the middle grayscale, the voltage of the control signal may be set relatively low.

As another example, when the second grayscale value of the pixel PXL at the present time point is 23 grayscales or 1 grayscale, the bias drive control signal generator 720 may maintain the voltage of the control signal at about 7V. The luminance difference at the low grayscale may not be large. Accordingly, the voltage of the control signal may be maintained at about 7V because no momentary afterimage occurs.

When the monitoring time is set to 5 seconds, the bias drive control signal generator 720 may change the voltage of the control signal from about 7V to about 6.75V only for the second grayscale value having 48 grayscales and 87 grayscales.

When the monitoring time is set to 2 seconds, the bias drive control signal generator 720 may change the voltage of the control signal from about 7V to about 6.75V for the second grayscale value having 48 or more grayscales, and maintain the voltage of the control signal at about 7V for the second grayscale value having 48 or less grayscales.

That is, the bias drive control signal generator 720 may determine the voltage of the control signal based on the monitoring time (that is, the required momentary afterimage index) and the second grayscale value at the present time point.

In FIG. 9, the voltage of the control signal may be changed by about 0.25V. However, this is merely an example, and the voltage of the control signal may be variously changed based on the hysteresis characteristic (for example, the change amount in the threshold voltage) of the first transistor T1.

In FIG. 9, when the high grayscale stress may be applied to the pixel PXL, the lookup table LUT includes the voltage of the control signal according to the second grayscale value of the pixel PXL at the present time point and the monitoring time. However, the invention is not limited thereto.

When the low grayscale stress may be applied to the pixel PXL, the lookup table LUT may include the voltage of the control signal according to the second grayscale value of the pixel PXL and the monitoring time. For example, the lookup table LUT may include values of about 7V and about 7.25V instead of the values of about 6.75V and about 7V shown in FIG. 9.

As described with reference to FIGS. 7 to 9, the timing controller 25 (or the driving circuits 21 to 25) may calculate the stress of the pixel PXL, and may vary and set the control signal (that is, the control signal provided to the second gate electrode GE2 of the first transistor T1 in the pixel PXL of FIG. 2) based on the stress and the grayscale value at the present time point.

Figure 10:
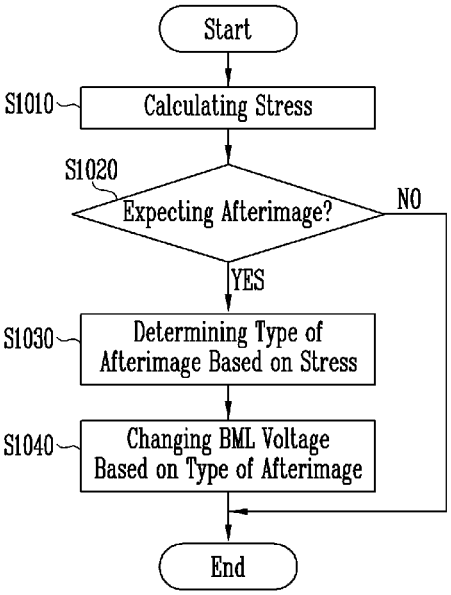
FIG. 10 is a schematic flowchart illustrating a method of driving a display device according to an embodiment of the invention.

FIG. 10 is a schematic flowchart illustrating a method of driving a display device according to an embodiment of the invention.

Referring to FIGS. 1 and 10, the method of FIG. 10 may be performed by the display device 1 of FIG. 1.

The method of FIG. 10 may calculate the stress of the pixel PXL based on the image data RGB (S1010).

As described with reference to FIGS. 7 and 8, the method of FIG. 10 may calculate the stress of the pixel PXL by accumulating the first grayscale values corresponding to the pixel PXL for a predetermined time.

The method of FIG. 10 may determine whether a momentary afterimage is generated based on the stress of the pixel PXL (S1020).

For example, when the stress applied to the pixel PXL is large, for example, in a state where the high grayscale stress may be applied to the pixel PXL, when the grayscale value of the pixel PXL at the present time point is the middle grayscale or the low grayscale (for example, 48 grayscales), the method of FIG. 10 may determine that the momentary afterimage may occur. In contrast, when the grayscale value of the pixel PXL at the present time point is the high grayscale, the method of FIG. 10 may determine that the momentary afterimage may not occur.

As another embodiment, for example, when the stress applied to the pixel PXL is small, for example, in a state where the low grayscale stress may be applied to the pixel PXL, when the grayscale value of the pixel PXL at the present time point is the middle grayscale or the high grayscale (for example, 48 grayscales), the method of FIG. 10 may determine that the momentary afterimage may occur.

In other words, when the difference between the stress of the pixel PXL and the grayscale value (or the value proportional to the grayscale value) of the pixel PXL at the present time point is larger than the reference value or outside the reference range, the method of FIG. 10 may determine that the momentary afterimage may occur.

When the occurrence of the momentary afterimage is expected, the method of FIG. 10 may determine the type (or the stress type) of the momentary afterimage on the basis of the stress of the pixel PXL (S1030).

For example, the method of FIG. 10 may compare the stress to the reference stress. When the stress is greater than the reference stress, the method of FIG. 10 may determine that the type of stress (that is, the stress type, or the type of afterimage) is the high grayscale stress WHITE-CLOSER STRESS. In another embodiment, when the stress is smaller than the reference stress, the method of FIG. 10 may determine that the type of stress is the low grayscale stress BLACK-CLOSER STRESS.

The method of FIG. 10 may change the voltage (or a BML, voltage) of the control signal based on the type of stress (and the stress) (S1040).

For example, when the type of stress is the high grayscale stress, the method of FIG. 10 may reduce the voltage of the control signal. As another example, when the type of stress is the low grayscale stress, the method of FIG. 10 may increase the voltage of the control signal.

In an embodiment, the method of FIG. 10 may change the voltage of the control signal based on the type of stress (and the stress) and the grayscale value of the pixel PXL at the present time point. As described with reference to FIG. 9, the method of FIG. 10 may change the voltage of the control signal using the lookup table.

As described with reference to FIG. 10, in the method of driving the display device according to the embodiments, the stress of the pixel PXL may be calculated, and the control signal (that is, the control signal provided to the second gate electrode GE2 of the first transistor T1 in the pixel PXL of FIG. 2) may be varied and set based on the stress and the grayscale value at the present time point. The threshold voltage of the first transistor T1 in the pixel PXL may be varied by the control signal, and the hysteresis characteristic of the first transistor T1 may be compensated for. Therefore, even when the first transistor T1 may be subjected to various stresses, the pixel PXL may emit light at the desired luminance.

Figure 11:
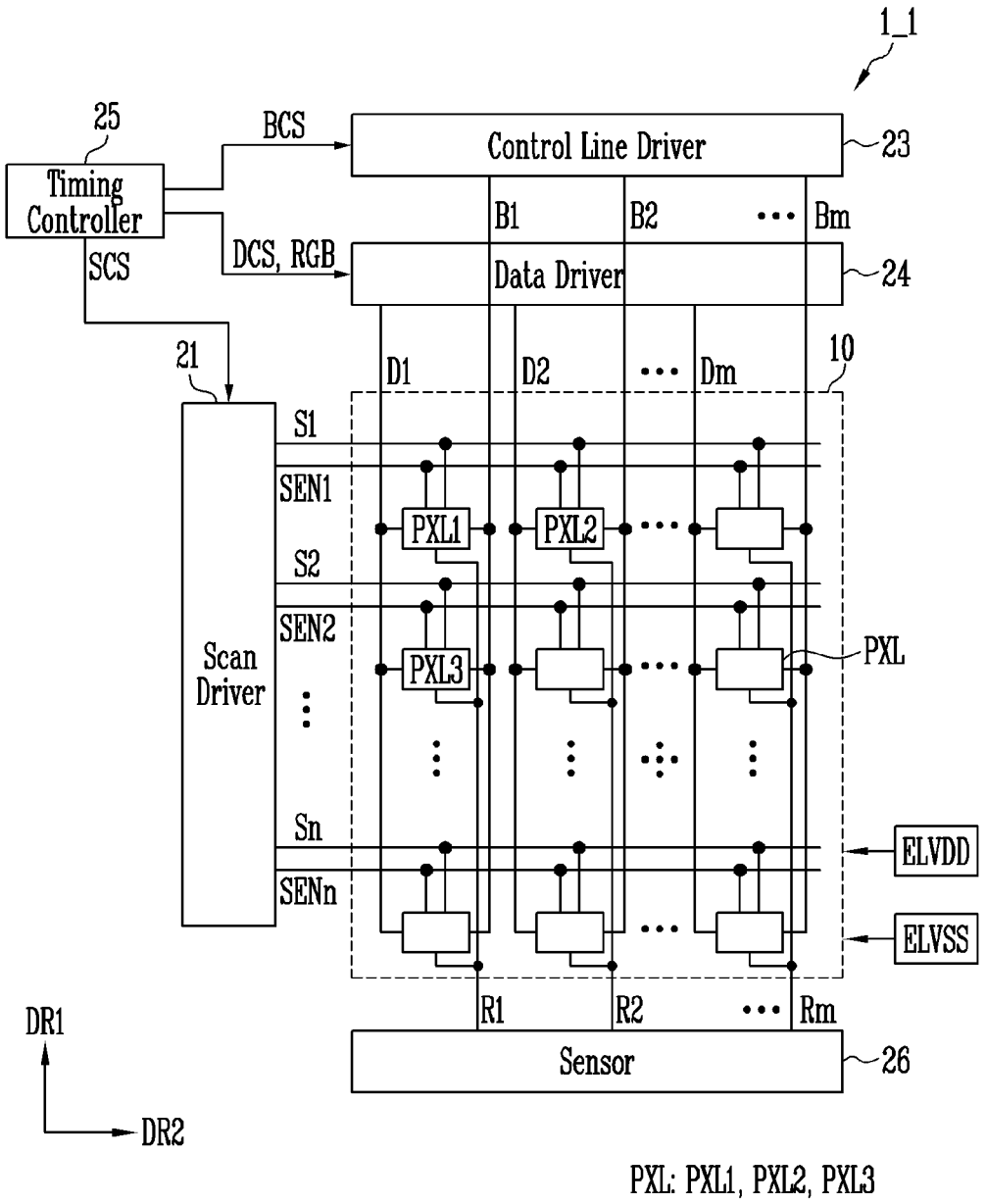
FIG. 11 is a schematic block diagram illustrating a display device according to another embodiment of the invention.
Figure 12:
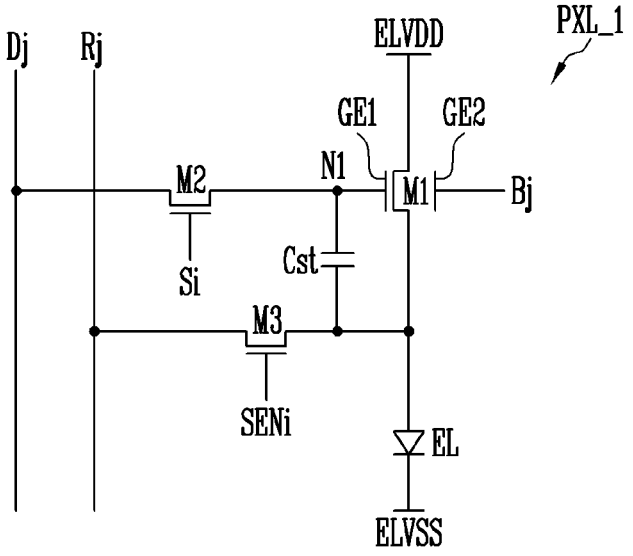
FIG. 12 is a schematic circuit diagram illustrating an example of a pixel included in the display device of FIG. 11.

FIG. 11 is a schematic block diagram illustrating a display device according to another embodiment of the invention. FIG. 12 is a schematic circuit diagram illustrating an example of a pixel included in the display device of FIG. 11.

Referring to FIGS. 1 and 11, a display device 1_1 may be different from the display device 1 of FIG. 1 in that the display device 1_1 may further include a sensor 26. The display device 1_1 may not include the emission control driver illustrated in FIG. 1. Except for the sensor 26, since the display device 1_1 may be substantially the same as or similar to the display device 1 of FIG. 1, repeated descriptions thereof will not be repeated.

The display region 10 may further include sensing lines SEN1 to SENn and read out lines R1 to Rm. The pixels PXL may be electrically connected to the sensing lines SEN1 to SENn and the read out lines R1 to Rm.

According to an embodiment, the sensing lines SEN1 to SENn may extend along the horizontal direction (the second direction DR2) in the display region 10 and may be commonly electrically connected to the pixels PXL (for example, the first pixel PXL1 and the second pixel PXL2) positioned on each horizontal line. The read out lines R1 to Rm may extend along the vertical direction (the first direction DR1) in the display region 10 so as to intersect the sensing lines SEN1 to SENn and may be commonly electrically connected the pixels PXL (for example, the first pixel PXL1 and the third pixel PXL3) positioned on each vertical line.

The scan driver 21 may receive the scan drive control signal SCS from the timing controller 25 and supply sensing scan signals to the sensing lines SEN1 to SENn in response to the scan drive control signal SCS. For example, the scan driver 21 may sequentially supply the sensing scan signals to the sensing lines SEN1 to SENn in response to the scan drive control signal SCS. When the sensing scan signals are supplied to the sensing lines SEN1 to SENn, respectively, the pixels PXL electrically connected to the sensing line to which the sensing scan signal may be supplied may be selected, and characteristic information of the pixels PXL may be output to the sensor 26 through the read out lines R1 to Rm. For example, the characteristic information of the pixels PXL may include mobility information and threshold voltage information of the driving transistors, deterioration information of the light emitting element, and the like.

The sensor 26 may measure characteristics of the pixels according to the current or voltage received through the read out lines R1 to Rm.

Referring to FIG. 12, a pixel PXL_1 may be disposed in the i-th pixel row (for example, the i-th horizontal line) and the j-th pixel column (for example, the j-th vertical line) of the display region 10 (refer to FIG. 1), and may be electrically connected to the i-th scan line Si, an i-th sensing line SENi, the j-th bias control line Bj, the j-th data line Dj, and a j-th read out line Rj, where i and j may be positive integers.

The pixels PXL disposed in the display region 10 of FIG. 11 may have substantially the same structure. Hereinafter, the i-th scan line Si, the i-th sensing line SENi, the j-th bias control line Bj, the j-th data line Dj, and the j-th read out line Rj are referred to as a scan line Si, a sensing line SENi, a bias control line Bj, a data line Dj, and a read out line Rj, respectively.

The pixel PXL_1 may include thin film transistors M1, M2, and M3 (or transistors), a storage capacitor Cst, and a light emitting element EL. The thin film transistors M1, M2, and M3 may include an oxide semiconductor and may be implemented as N-type transistors.

A first thin film transistor M1 may include a first gate electrode GE1 electrically connected to a first node N1, one electrode (or a first electrode) electrically connected to a first power source ELVDD, and another electrode (or a second electrode) electrically connected to one electrode of the light emitting element EL. A second gate electrode GE2 of the first thin film transistor M1 may be electrically connected to the bias control line Bj. The first thin film transistor M1 may be referred to as a driving transistor.

Similar to the first transistor T1 described with reference to FIGS. 2 and 4, the first gate electrode GE1 of the first thin film transistor M1 may be disposed closer to a channel region than the second gate electrode GE2. The first thin film transistor M1 may control a voltage of the first node N1 applied to the first gate electrode GE1 to express respective grayscales. A control signal having a predetermined voltage may be applied to the second gate electrode GE2 of the first thin film transistor M1 through the bias control line Bj. For example, as a voltage applied to the second gate electrode GE2 decreases, a threshold voltage of the first thin film transistor M1 may decrease. On the contrary, as the voltage applied to the second gate electrode GE2 increases, the threshold voltage of the first thin film transistor M1 may increase. Therefore, the characteristic of the first thin film transistor M1 may be controlled by adjusting the voltage of the control signal supplied to the bias control line Bj.

A second thin film transistor M2 may include a gate electrode electrically connected to the scan line Si, one electrode electrically connected to the data line Dj, and another electrode electrically connected to the first node N1. The second thin film transistor M2 may be referred to as a switching transistor, a scan transistor, or the like.

A third thin film transistor M3 may include a gate electrode electrically connected to the sensing line SENi, one electrode electrically connected to the lead out line Rj, and another electrode electrically connected to one electrode of the light emitting element EL. The third thin film transistor M3 may be referred to as an initialization transistor, a sensing transistor, or the like.

One electrode of the storage capacitor Cst may be electrically connected to the first node N1, and another electrode of the storage capacitor Cst may be electrically connected to one electrode of the light emitting element EL.

The light emitting element EL may include an anode electrically connected to another electrode of the first thin film transistor M1 and a cathode electrically connected to a power source line ELVSS. The light emitting element EL may be composed of an organic light emitting diode, an inorganic light emitting diode, or the like.

The threshold voltage of the first thin film transistor M1 may be shifted in a specific direction (for example, in a positive direction) as time passes.

Therefore, the display device 1_1 (or the timing controller 25) according to the embodiments of the invention may calculate cumulative stress (or degree of degradation) of the pixel PXL based on the grayscale value included in an image data RGB, and linearly vary the voltage of the control signal (that is, the control signal applied to the second gate electrode GE2 of the first thin film transistor M1) based on the cumulative stress of the pixel PXL. Here, the cumulative stress (or the degree of deterioration) may represent total stress applied to the pixel PXL by the use of the pixel PXL from the time of manufacture of the display device 1_1 to the present time. For example, the cumulative stress may be proportional to the grayscale value and the light emitting time (or the display time).

That is, although the threshold voltage of the first thin film transistor M1 may be shifted in one direction according to the use of the display device, the display device 1_1 may cancel the change in the threshold voltage of the first thin film transistor M1 by using the control signal applied to the second gate electrode GE2. Therefore, even if time elapses, a uniform driving current may flow through the light emitting element EL by the first transistor T1, and image quality may be improved.

In the display device and the method of driving the same according to the invention, the voltage of the control signal provided to the second gate electrode of the driving transistor having the dual gate structure may be increased or decreased based on the stress (for example, stress in proportion to data signal and grayscale value) of the driving transistor. Therefore, as the threshold voltage of the driving transistor is changed by the control signal, the hysteresis characteristic of the driving transistor and the momentary afterimage resulting from the hysteresis characteristic of the driving transistor may be alleviated or eliminated, and the image quality of the display device may be improved.

The detailed description of the invention with reference to the accompanying drawings is merely illustrative of the invention, and is used only for the purpose of illustrating the invention and is not intended to limit the meaning of the invention or to limit the scope of the invention described in the claims. Therefore, those skilled in the art will understand that various modifications and equivalent other embodiments are possible therefrom. The true technical protection scope of the invention should be defined by the technical spirit of the appended claims.

What is claimed is:

1. A display device comprising:

a driving circuit that drives a pixel; and a display region including the pixel, the pixel including:

a light emitting element electrically connected between a first power source and a second power source;

a first transistor electrically connected between the first power source and the light emitting element to control a driving current, the first transistor including:

a first gate electrode electrically connected to a first node; and a second gate electrode electrically connected to a bias control line; and a switching transistor electrically connected between a data line and the first node, the switching transistor including a gate electrode electrically connected to a scan line, wherein the driving circuit varies a control signal provided to the bias control line in a second period based on a first data signal provided to the data line during a first period, wherein the driving circuit controls a voltage level of the control signal to be smaller than a voltage level of a reference control voltage when a first grayscale value corresponding to the first data signal is greater than a reference grayscale value, and wherein the driving circuit controls the voltage level of the control signal to be greater than the voltage level of the reference control voltage when the first grayscale value is smaller than the reference grayscale value.

2. The display device of claim 1, wherein the driving circuit controls the voltage level of the control signal to be smaller than the voltage level of the reference control voltage when the first grayscale value is greater than the reference grayscale value, and a second grayscale value corresponding to a second data signal provided to the data line in the second period is less than or equal to the reference grayscale value.

3. The display device of claim 2, wherein the driving circuit controls the voltage level of the control signal to be greater than the voltage level of the reference control voltage when the first grayscale value is smaller than the reference grayscale value, and the second grayscale value corresponding to the second data signal is greater than the reference grayscale value.

4. The display device of claim 1, wherein the first transistor includes a silicon semiconductor and is a P-type transistor.

5. The display device of claim 4, wherein the first transistor includes a semiconductor pattern, the first gate electrode is disposed on the semiconductor pattern with a first insulating layer disposed between the first gate electrode and the semiconductor pattern, the second gate electrode is disposed under the semiconductor pattern with a second insulating layer disposed between the second gate electrode and the semiconductor pattern, a thickness of the second insulating layer is greater than a thickness of the first insulating layer, and a threshold voltage of the first transistor is varied according to the voltage level of the control signal applied to the second gate electrode.

6. The display device of claim 5, wherein the threshold voltage of the first transistor is shifted in a positive direction when the voltage level of the control signal is decreased, and the threshold voltage of the first transistor is shifted in a negative direction when the voltage level of the control signal is increased.

7. The display device of claim 1, wherein the driving circuit accumulates the first grayscale value during the first period to calculate a stress of the first transistor, and determines the voltage level of the control signal based on the stress and a second grayscale value corresponding to a second data signal provided to the data line in the second period.

8. The display device of claim 7, wherein the driving circuit initializes and recalculates the stress with a predetermined period.

9. The display device of claim 8, wherein the control signal has a fixed voltage level during the predetermined period.

10. The display device of claim 7, wherein the driving circuit includes a lookup table that stores voltage information of the control signal according to the second grayscale value.

11. The display device of claim 1, wherein the driving circuit controls the voltage level of the control signal to be equal to the voltage level of the reference control voltage when a difference between the first grayscale value and the reference grayscale value is smaller than a reference value.

12. The display device of claim 2, wherein the driving circuit accumulates the first grayscale value corresponding to the first data signal to calculate a cumulative stress, and linearly varies the voltage level of the control signal as the cumulative stress increases.

13. A display device comprising:

a first data line and a first bias control line that are disposed in a display region and extend in a first direction;

scan lines disposed in the display region and extending in a second direction crossing the first direction;

a first pixel and a second pixel that are disposed in the display region and electrically connected to the first data line and the first bias control line, each of the first pixel and the second pixel including:

a light emitting element electrically connected between a first power source and a second power source;

a first transistor electrically connected between the first power source and the light emitting element to control a driving current, the first transistor including:

a first gate electrode electrically connected to a first node; and a second gate electrode electrically connected to the first bias control line; and a switching transistor electrically connected between the first data line and the first node, the switching transistor including a gate electrode electrically connected to a corresponding scan line among the scan; and a driving circuit that drives the first pixel and the second pixel, wherein the driving circuit varies a control signal provided to the first bias control line in a second period based on a first data signal provided to the first data line during a first period, the driving circuit controls a voltage level of the control signal to be smaller than a voltage level of a reference control voltage when a first grayscale value corresponding to the first data signal is greater than a reference grayscale value, and the driving circuit controls the voltage level of the control signal to be greater than the voltage level of the reference control voltage when the first grayscale value is smaller than the reference grayscale value.

14. The display device of claim 13, further comprising:

a second data line and a second bias control line that are disposed in the display region and extend in the first direction, respectively; and a third pixel electrically connected to the second data line and the second bias control line, wherein the third pixel is disconnected to the first bias control line.

15. A method of driving a display device including a pixel having a driving transistor, the method comprising:

calculating a stress of the pixel based on a first data signal provided to a first gate electrode of the driving transistor during a first period; and varying a voltage level of a control signal provided to a second gate electrode of the driving transistor in a second period based on the stress and a second data signal provided to the first gate electrode in the second period, wherein the varying the voltage level of the control signal includes;

controlling the voltage level of the control signal to be smaller than a voltage level of a reference control voltage when a first grayscale value corresponding to the first data signal is greater than a reference grayscale value; and controlling the voltage level of the control signal to be greater than the voltage level of the reference control voltage when the first grayscale value is smaller than the reference grayscale value.

16. The method of claim 15, wherein the driving transistor includes a silicon semiconductor and is a P-type transistor.

17. The method of claim 15, wherein the varying the voltage level of the control signal further includes:

controlling the voltage level of the control signal to be smaller than the voltage level of the reference control voltage when the first grayscale value is greater than the reference grayscale value and a second grayscale value corresponding to the second data signal is less than or equal to the reference grayscale value, and controlling the voltage level of the control signal to be greater than the voltage level of the reference control voltage when the first grayscale value is smaller than the reference grayscale value and the second grayscale value corresponding to the second data signal is greater than the reference grayscale value.

* * * * *